US010133201B2

(12) United States Patent
Kamae et al.

(10) Patent No.: US 10,133,201 B2
(45) Date of Patent: Nov. 20, 2018

(54) TONER

(71) Applicant: CANON KABUSHIKI KAISHA, Tokyo (JP)

(72) Inventors: Kentaro Kamae, Kashiwa (JP); Ryuichiro Matsuo, Moriya (JP); Yosuke Iwasaki, Abiko (JP); Wakiko Katsumata, Kashiwa (JP); Kenta Mitsuiki, Toride (JP); Takeshi Ohtsu, Toride (JP); Masaharu Miura, Toride (JP); Koh Ishigami, Abiko (JP); Yuichi Mizo, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/661,344

(22) Filed: Jul. 27, 2017

(65) Prior Publication Data

US 2018/0031990 A1 Feb. 1, 2018

(30) Foreign Application Priority Data

Aug. 1, 2016 (JP) ..... 2016-151244
Jul. 7, 2017 (JP) ..... 2017-133508

(51) Int. Cl.
*G03G 9/08* (2006.01)
*G03G 9/087* (2006.01)
*G03G 9/09* (2006.01)

(52) U.S. Cl.
CPC ..... *G03G 9/08755* (2013.01); *G03G 9/0808* (2013.01); *G03G 9/0819* (2013.01); *G03G 9/0821* (2013.01); *G03G 9/0827* (2013.01); *G03G 9/08795* (2013.01); *G03G 9/08797* (2013.01); *G03G 9/0918* (2013.01)

(58) Field of Classification Search
CPC ..... G03G 9/0821; G03G 9/08755
USPC ..... 430/109.4, 111.4
See application file for complete search history.

(56) References Cited

U.S. PATENT DOCUMENTS 7,279,262 B2 10/2007 Fujikawa et al.
7,288,348 B2 10/2007 Hayami et al.
7,396,626 B2 7/2008 Fujikawa et al.
(Continued)

FOREIGN PATENT DOCUMENTS

JP 2004-046095 A 2/2004

OTHER PUBLICATIONS

U.S. Appl. No. 15/431,821, Koh Ishigami, filed Feb. 14, 2017.
U.S. Appl. No. 15/457,124, Takeshi Ohtsu, filed Mar. 13, 2017.
U.S. Appl. No. 15/673,672, Yosuke Iwasaki, filed Aug. 10, 2017.

*Primary Examiner* — Mark A Chapman
(74) *Attorney, Agent, or Firm* — Fitzpatrick Cella Harper and Scinto

(57) ABSTRACT

Provided is a toner including a toner particle containing an amorphous resin, a colorant, a release agent, and a crystalline resin, wherein, when $\eta_{0.01}$ represents the extensional viscosity of the toner at a Hencky strain at 90° C. of 0.01 and $\eta_{0.69}$ represents the extensional viscosity of the toner at a Hencky strain at 90° C. of 0.69, $\eta_{0.01}$ and $\eta_{0.69}$ satisfy the relationships of the following formulas (1) and (2):

$$3.0\times10^4\ \text{Pa}\leq\eta_{0.01}\leq2.0\times10^5\ \text{Pa} \quad \text{formula (1)}$$

$$2.0\leq[\eta_{0.69}/\eta_{0.01}]. \quad \text{formula (2)}$$

11 Claims, 2 Drawing Sheets

(56) References Cited

U.S. PATENT DOCUMENTS

| | | | |
|---|---|---|---|
| 7,396,629 | B2 | 7/2008 | Baba et al. |
| 7,611,813 | B2 | 11/2009 | Ida et al. |
| 7,629,100 | B2 | 12/2009 | Okamoto et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,084,174 | B2 | 12/2011 | Hasegawa et al. |
| 8,114,562 | B2 | 2/2012 | Ishigami et al. |
| 8,137,886 | B2 | 3/2012 | Baba et al. |
| 8,298,742 | B2 | 10/2012 | Okamoto et al. |
| 8,323,726 | B2 | 12/2012 | Naka et al. |
| 8,921,023 | B2 | 12/2014 | Baba et al. |
| 8,927,188 | B2 | 1/2015 | Naka et al. |
| 8,945,805 | B2 | 2/2015 | Baba et al. |
| 8,974,994 | B2 | 3/2015 | Kamae et al. |
| 8,986,914 | B2 | 3/2015 | Nemat-Nasser et al. |
| 9,034,551 | B2 | 5/2015 | Endo et al. |
| 9,046,800 | B2 | 6/2015 | Hotta et al. |
| 9,058,924 | B2 | 6/2015 | Komatsu et al. |
| 9,063,443 | B2 | 6/2015 | Ishigami et al. |
| 9,075,328 | B2 | 7/2015 | Minagawa et al. |
| 9,152,088 | B1 | 10/2015 | Kobori et al. |
| 9,372,420 | B2 | 6/2016 | Mizo et al. |
| 9,417,540 | B2 | 8/2016 | Hashimoto et al. |
| 9,436,112 | B2 | 9/2016 | Iwasaki et al. |
| 9,665,021 | B2 | 5/2017 | Ohtsu et al. |
| 9,665,023 | B2 | 5/2017 | Kamae et al. |
| 9,671,707 | B2 | 6/2017 | Minagawa et al. |
| 2009/0233212 | A1 | 9/2009 | Fujikawa et al. |
| 2010/0028796 | A1 | 2/2010 | Nakamura et al. |
| 2010/0183971 | A1 | 7/2010 | Fujikawa et al. |
| 2012/0077000 | A1* | 3/2012 | Putnam ..... G03G 13/20 428/207 |
| 2012/0214097 | A1 | 8/2012 | Naka et al. |
| 2013/0244159 | A1 | 9/2013 | Ishigami et al. |
| 2013/0288173 | A1 | 10/2013 | Hashimoto et al. |
| 2013/0309603 | A1 | 11/2013 | Takahashi et al. |
| 2014/0134535 | A1 | 5/2014 | Baba et al. |
| 2014/0137428 | A1 | 5/2014 | Takenaka et al. |
| 2014/0329176 | A1 | 11/2014 | Kanno et al. |
| 2016/0334725 | A1 | 11/2016 | Katsumata et al. |
| 2017/0058067 | A1 | 3/2017 | Ohtsu et al. |

* cited by examiner

TONER

BACKGROUND OF THE INVENTION

Field of the Invention

The present invention relates to a toner used in, for example, electrophotographic systems, electrostatic recording systems, electrostatic printing systems, and toner jet systems.

Description of the Related Art

The widespread dissemination of electrophotographic system-based full-color copiers in recent years has also been accompanied by requirements, such as for higher speeds, higher image qualities, and greater energy conservation. There is demand for toners that can undergo fixing at lower fixation temperatures as a specific energy conservation measure in order to lower the power consumption in the fixing step.

Thus, in order to achieve low-temperature fixation, Japanese Patent Application Laid-open No. 2004-046095 proposes a toner that uses a crystalline polyester resin as a plasticizer for amorphous polyester resin.

SUMMARY OF THE INVENTION

The use of the crystalline polyester resin did lower the viscosity of the plasticized amorphous polyester resin and a certain effect on the low-temperature fixability was obtained. However, when this toner was printed in a high-temperature, high-humidity environment on media with a low areal weight, due to the small viscous stress for the reduced-viscosity toner, the media in some instances did not release from the fixing roller and wrapped around the fixing roller. That is, the low-temperature fixability and the fixing release performance reside in a trade-off relationship.

Moreover, that has been demand in recent years for high productivity even from multimedia machines, which are not limited to plain paper and can accommodate a variety of media, e.g., thick paper, thin paper, and so forth.

Specifically, there is demand for the realization of a "uniform media speed capability" whereby printing can be carried out across a variety of media without changing the process speed. However, for the majority of current machines, when both thick paper and thin paper are loaded and thin paper is printed after thick paper, down time is required in order to cool the fixing roller in order to prevent wraparound at the fixing roller. Thus, the realization of a "uniform media speed capability" requires a toner for which a low-temperature fixability that enables fixing with even thick paper coexists with a fixing release performance whereby even thin paper can be released from the fixing roller.

In view of these considerations, it is thus an urgent task to develop a toner in which the low-temperature fixability coexists with the fixing release performance.

The present invention seeks to provide a toner that solves this problem.

In specific terms, the present invention seeks to provide a toner in which the low-temperature fixability coexists with the fixing release performance.

The present invention relates to a toner including a toner particle containing an amorphous resin, a colorant, a release agent, and a crystalline resin, wherein, when $\eta_{0.01}$ represents the extensional viscosity of the toner at a Hencky strain at 90° C. of 0.01 and $\eta_{0.69}$ represents the extensional viscosity of the toner at a Hencky strain at 90° C. of 0.69, $\eta_{0.01}$ and $\eta_{0.69}$ satisfy the relationships of the following formulas (1) and (2):

$$3.0\times10^4\ \text{Pa}\leq\eta_{0.01}\leq2.0\times10^5\ \text{Pa} \quad \text{formula (1)}$$

$$2.0\leq[\eta_{0.69}/\eta_{0.01}]. \quad \text{formula (2)}$$

Further features of the present invention will become apparent from the following description of exemplary embodiments with reference to the attached drawings.

DESCRIPTION OF THE EMBODIMENTS

Figure 1:
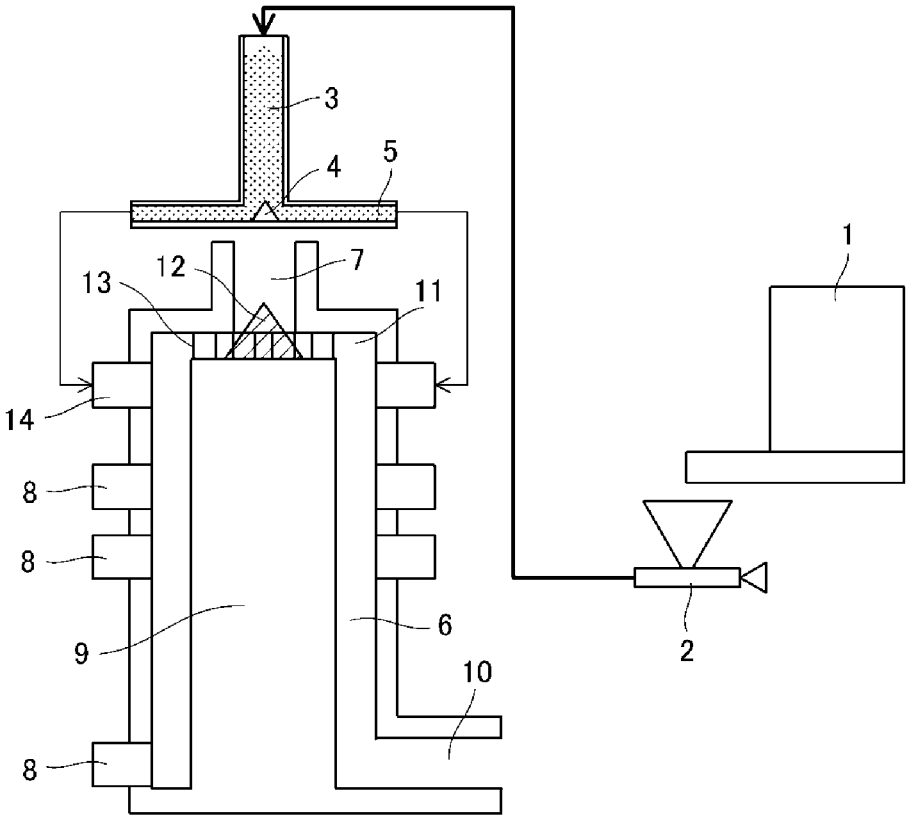
FIG. 1 is a schematic diagram of a heat-treatment apparatus.

Unless specifically indicated otherwise, expressions such as "at least XX and not more than YY" and "XX to YY" that show numerical value ranges refer in the present invention to numerical value ranges that include the lower limit and upper limit that are the end points.

The toner of the present invention is a toner including a toner particle containing an amorphous resin, a colorant, a release agent, and a crystalline resin, wherein, when $\eta_{0.01}$ represents the extensional viscosity of the toner at a Hencky strain at 90° C. of 0.01 and $\eta_{0.69}$ represents the extensional viscosity of the toner at a Hencky strain at 90° C. of 0.69, $\eta_{0.01}$ and $\eta_{0.69}$ satisfy the relationships of the following formulas (1) and (2):

$$3.0\times10^4\ \text{Pa}\leq\eta_{0.01}\leq2.0\times10^5\ \text{Pa} \quad \text{formula (1)}$$

$$2.0\leq[\eta_{0.69}/\eta_{0.01}]. \quad \text{formula (2)}$$

From the standpoint of the melt viscosity of toner, it is empirically known that the low-temperature fixability and fixing release performance reside in a trade-off relationship.

Elucidation of the mechanism underlying the fixing release event was pursued in order to overcome this trade-off relationship. As a result, the discovery was made that the fixing release event can be explained by the fixing roller/toner interfacial attachment force and the viscous stress for the toner.

Thus, when the melt viscosity of the toner is a high viscosity, the viscous stress for the toner is high and due to this the low-temperature fixability is impaired while the fixing release performance is excellent.

When, on the other hand, the melt viscosity of the toner is a low viscosity, the low-temperature fixability is excellent while the viscous stress for the toner is low and as a consequence the fixing separation performance is impaired.

In order to overcome this trade-off relationship, methods based on generating a releasing effect using a release agent have been investigated. These attempt to lower the fixing roller/toner interfacial attachment force.

However, at present, the interfacial attachment force has become quite low due to the wax in toners and due to the tetrafluoroethylene. perfluoroalkyl vinyl ether copolymer (PFA) that is generally used as a fixing roller material.

Moreover, when image output is performed on a long-term basis in a high-temperature, high-humidity environment, the temperature within the main copier unit rises and this causes the release agent in the vicinity of the toner surface to assume a soft state and the inorganic fine particles that are an external additive are then buried in the interior of the toner and the transfer efficiency may decline. In such a case, a portion of the toner image on the intermediate transfer member may not transfer and the image defects referred to as white spots may be produced. An art that improves the fixing release performance without relying on a release agent is thus required.

The present inventors therefore carried out investigations on the viscous stress for the toner focusing on the toner extension phenomenon at the fixing nip outlet. That is, the present invention was achieved based on the thinking that the low-temperature fixability could coexist with the fixing release performance if, for a toner that had a low viscosity during passage through the fixing nip, an increased viscosity could be established accompanying the extension phenomenon of the toner at the fixing nip outlet.

In addition, coexistence between the low-temperature fixability and fixing release performance was obtained when the toner of the present invention was evaluated. Moreover, a high transferability could be maintained even during long-term image output.

The present inventors refer to the viscosity increase phenomenon during toner extension as "strain hardening", and, while carrying out investigations on this "strain hardening", hit upon a viscoelastic measurement apparatus that had a uniaxial extension viscosity measurement tool and could measure the viscosity during toner extension.

After this, the present inventors carried out additional focused investigations and calculated an index that would show an excellent fixing release performance versus the interfacial attachment force between the toner and fixing rollers made of the usual fixing film materials and most importantly PFA.

This calculation was carried out using a simulation that considered the curvature of the fixing roller and the process speed. An index that can indicate an excellent low-temperature fixability was also computed.

Since the toner temperature during passage through the fixing nip and at the fixing nip outlet is about 90° C., the extensional viscosity-strain characteristics at 90° C. were used for the index.

Since the toner does not undergo extension during passage through the fixing nip, the extensional viscosity $\eta_{0.01}$ at a Hencky strain of 0.01 was used as the index for indicating the low-temperature fixability.

Since the toner undergoes extension at the fixing nip outlet and an approximately two-fold extension was shown by the simulation, the extensional viscosity $\eta_{0.69}$ at a Hencky strain of 0.69 was used as the index for indicating the fixing release performance.

From the perspective of the low-temperature fixability, $\eta_{0.01}$—where $\eta_{0.01}$ is the extensional viscosity when the Hencky strain of the toner at 90° C. is 0.01—is at least $3.0\times10^4$ Pa and not more than $2.0\times10^5$ Pa and is preferably at least $6.0\times10^4$ Pa and not more than $1.0\times10^5$ Pa.

When the extensional viscosity $\eta_{0.01}$ is in the indicated range, the toner has a low melt viscosity and an excellent low-temperature fixability is obtained as a result.

When the extensional viscosity $\eta_{0.01}$ is less than $3.0\times10^4$ Pa, the low-temperature fixability is excellent, but the toner also has a low molecular weight and as a consequence "strain hardening" does not appear and an excellent fixing release performance is not obtained.

The reason for this originates with the "strain hardening" mechanism.

It is thought that "strain hardening" is generated through the combination of a certain molecular chain length and a certain degree of branching due to crosslinking structures. Thus, during extension, molecular chains that have formed a mesh with each other become entangled, which produces a stress counter to the extension, and "strain hardening" is thereby generated.

As a consequence, when the toner has a low molecular weight, few molecular chains are formed into a mesh and there is then little entanglement during extension and "strain hardening" does not appear.

Moreover, when the extensional viscosity $\eta_{0.01}$ is larger than $2.0\times10^5$ Pa, the fixing release performance is excellent, but an excellent low-temperature fixability is not obtained due to the high melt viscosity for the toner.

Adjusting the polymerization time during production of the amorphous resin is an example of a procedure for adjusting the extensional viscosity $\eta_{0.01}$ into the indicated range.

Viewed from the perspective of the fixing release performance, the relationship between $\eta_{0.01}$ and $\eta_{0.69}$—where $\eta_{0.69}$ is the extensional viscosity of the toner when the Hencky strain at 90° C. is 0.69—is $2.0\leq[\eta_{0.69}/\eta_{0.01}]$ and is preferably $2.5\leq[\eta_{0.69}/\eta_{0.01}]$. The upper limit is not particularly limited, but is preferably not more than 3.0.

When $[\eta_{0.69}/\eta_{0.01}]$ is in the indicated range, "strain hardening" is realized and an excellent fixing release performance is obtained as a result.

When $[\eta_{0.69}/\eta_{0.01}]$ is less than 2.0, little "strain hardening" is produced and an excellent fixing release performance is then not obtained.

The following are examples of procedures for adjusting $[\eta_{0.69}/\eta_{0.01}]$ into the indicated range: incorporation, as a constituent component of the amorphous resin, of a monomer unit derived from a tribasic or higher basic carboxylic acid or derivative thereof; adjustment of the content thereof; and adjustment of the polymerization time during production of the amorphous resin.

Viewed from the perspective of the fixing release performance, $\eta_{0.69}$ is preferably at least $1.0\times10^5$ Pa and not more than $4.0\times10^5$ Pa and is more preferably at least $1.5\times10^5$ Pa and not more than $2.5\times10^5$ Pa.

An excellent fixing release performance is obtained when the extensional viscosity $\eta_{0.69}$ is in the indicated range because "strain hardening" is then generated relative to the extensional viscosity $\eta_{0.01}$.

The following are examples of procedures for adjusting the extensional viscosity $\eta_{0.69}$ into the indicated range: incorporation, as a constituent component of the amorphous resin, of a monomer unit derived from a tribasic or higher basic carboxylic acid or derivative thereof; adjustment of the content thereof; and adjustment of the polymerization time during production of the amorphous resin.

The amorphous resin preferably contains an amorphous polyester resin A that has the properties indicated in the following.

From the standpoint of the low-temperature fixability, $\eta_{0.01(A)}$—where $\eta_{0.01(A)}$ is the extensional viscosity of the amorphous polyester resin A at a Hencky strain at 90° C. of 0.01—is preferably at least $2.5\times10^5$ Pa and not more than $7.5\times10^5$ Pa and is more preferably at least $4.0\times10^5$ Pa and not more than $5.5\times10^5$ Pa.

When the extensional viscosity $\eta_{0.01(A)}$ is in the indicated range, the toner has a low melt viscosity and an excellent low-temperature fixability is obtained as a consequence.

In addition, from the standpoint of the fixing release performance, the relationship between $\eta_{0.01(A)}$ and $\eta_{0.69(A)}$—where $\eta_{0.69(A)}$ is the extensional viscosity of the amorphous polyester resin A at a Hencky strain at 90° C. of 0.69—is preferably $3.0\leq[\eta_{0.69(A)}/\eta_{0.01(A)}]$ and is more preferably $4.0 \leq [\eta_{0.69(A)}/\eta_{0.01(A)}]$. The upper limit here is not particularly limited, but is preferably not more than 5.0.

When $[\eta_{0.69(A)}/\eta_{0.01(A)}]$ is in the indicated range, this facilitates the appearance of "strain hardening" and an excellent fixing release performance is then obtained.

The following are examples of procedures for adjusting $[\eta_{0.69(A)}/\eta_{0.01(A)}]$ into the indicated range: incorporation, as a constituent component of the amorphous polyester resin, of a monomer unit derived from a tribasic or higher basic carboxylic acid or derivative thereof; adjustment of the content thereof; and adjustment of the polymerization time during production of the amorphous polyester resin.

Viewed from the standpoint of the fixing release performance, $\eta_{0.69(A)}$ is also preferably at least $1.0\times10^6$ Pa and not more than $2.0\times10^6$ Pa and is more preferably at least $1.5\times10^6$ Pa and not more than $1.8\times10^6$ Pa.

When the extensional viscosity $\eta_{0.69(A)}$ is in the indicated range, "strain hardening" occurs relative to the extensional viscosity $\eta_{0.01(A)}$ and an excellent fixing release performance is obtained as a result.

The following are examples of procedures for adjusting the extensional viscosity $\eta_{0.69(A)}$ into the indicated range: incorporation, as a constituent component of the amorphous polyester resin, of a monomer unit derived from a tribasic or higher basic carboxylic acid or derivative thereof; adjustment of the content thereof; and adjustment of the polymerization time during production of the amorphous polyester resin.

The amorphous resin preferably contains an amorphous polyester resin as its main component. Here, main component means that the content of the amorphous polyester resin in the amorphous resin is at least 50 mass %. The amorphous polyester resin contains monomer unit derived from alcohol and monomer unit derived from carboxylic acid.

Viewed in terms of the coexistence of the low-temperature fixability with the fixing release performance, the content of the aforementioned amorphous polyester resin A in the toner is preferably at least 40.0 mass % and not more than 70.0 mass % and is more preferably at least 55.0 mass % and not more than 70.0 mass %.

When the amorphous polyester resin A is present in the indicated range, this amorphous polyester resin A is then present as the main binder in the toner and thus becomes the dominant factor with respect to the low-temperature fixability and the fixing release performance. The manifestation of the properties of the amorphous polyester resin A is thus facilitated and an even better low-temperature fixability and fixing release performance are then obtained.

The amorphous polyester resin A has a monomer unit derived from polyhydric alcohol and a monomer unit derived from polybasic carboxylic acid, and, viewed in terms of the fixing release performance, the content—in the monomer unit derived from polybasic carboxylic acid—of a monomer unit derived from at least one compound selected from the group consisting of tribasic and higher basic carboxylic acids and derivatives thereof is preferably at least 25.0 mol % and not more than 80.0 mol % and more preferably at least 30.0 mol % and not more than 50.0 mol %.

In the present invention, monomer unit refers to the state of the reacted monomer substance in the polymer or resin.

As noted above, "strain hardening" is thought to be generated through the combination of a certain molecular chain length and a certain degree of branching due to crosslinking structures. Thus, a certain amount of multifunctional monomer should be present in order to have branching due to crosslinking structures. Since, when the amount of multifunctional monomer is in the indicated range, branching structures can be formed while securing a certain molecular chain length, the generation of "strain hardening" is then facilitated and an excellent fixing release performance is readily obtained.

The alcohol can be exemplified by dihydric alcohols and trihydric and higher hydric polyhydric alcohols and by derivatives thereof.

The carboxylic acid can be exemplified by dibasic carboxylic acids and tribasic and higher basic polybasic carboxylic acids and by derivatives thereof.

The derivatives here should provide the same monomer unit structure by condensation polymerization, but are not otherwise particularly limited. Examples are the ester derivatives of diols; the anhydrides of carboxylic acids; and the alkyl esters and acid chlorides of carboxylic acids.

Here, partial crosslinking within the amorphous resin molecule is effective for producing a branched polymer in order to bring about the occurrence of "strain hardening". A trivalent or higher valent polyfunctional compound is preferably used for this purpose. Accordingly, as noted above, the starting monomer for the amorphous polyester resin A preferably contains at least one compound selected from the group consisting of tribasic and higher basic carboxylic acids and derivatives thereof, and/or at least one compound selected from the group consisting of trihydric and higher hydric alcohols and derivatives thereof.

The dihydric alcohols can be exemplified by the following:

ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols given by the following formula (I) and derivatives thereof, and diols given by the following formula (II).

(I)

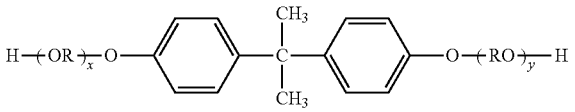

(In the formula, R is an ethylene group or propylene group; x and y are each integers equal to or greater than 0; and the average value of x+y is at least 0 and not more than 10.)

(II)

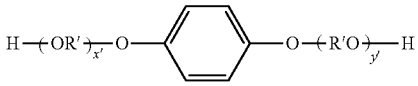

(In the formula, R' is

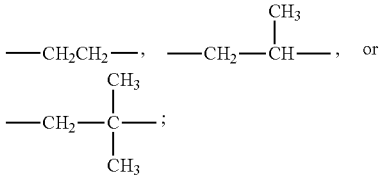

or

;

x' and y' are each integers equal to or greater than 0; and the average value of x'+y' is at least 0 and not more than 10.)

The trihydric and higher hydric alcohols can be exemplified by the following:

sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

The use is preferred among the preceding of glycerol, trimethylolpropane, and pentaerythritol.

A single dihydric alcohol may be used by itself or a plurality may be used in combination, and a single trihydric or higher hydric alcohol may be used by itself or a plurality may be used in combination.

Specific examples of dibasic carboxylic acids are as follows:

maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, and their anhydrides and lower alkyl esters.

The use is preferred among the preceding of maleic acid, fumaric acid, terephthalic acid, and n-dodecenylsuccinic acid.

The tribasic and higher basic carboxylic acids can be exemplified by the following:

1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, 1,2,4-cyclohexanetricarboxylic acid, tetra(methylenecarboxy) methane, 1,2,7,8-octanetetracarboxylic acid, pyromellitic acid, Empol trimer acid, and the anhydrides and lower alkyl esters of the preceding.

Among the preceding, the use of 1,2,4-benzenetricarboxylic acid, i.e., trimellitic acid, and derivatives thereof is preferred because they are inexpensive and facilitate control of the reaction.

A single dibasic carboxylic acid may be used by itself or a plurality may be used in combination, and a single tribasic or higher basic carboxylic acid may be used by itself or a plurality may be used in combination.

There are no particular limitations on the method for producing the amorphous polyester resin and a known method can be used. For example, the polyester resin may be produced by the simultaneous introduction of the aforementioned alcohol and carboxylic acid and polymerization via an esterification reaction or transesterification reaction and a condensation reaction.

The polymerization temperature is also not particularly limited, but is preferably in the range of at least 180° C. and not more than 290° C. A polymerization catalyst may be used during the polymerization of the polyester, for example, a titanium catalyst, tin catalyst, zinc acetate, antimony trioxide, germanium dioxide, and so forth.

The amorphous resin may contain an additional resin component as long as amorphous polyester resin is the main component.

This additional resin component can be exemplified by a hybrid resin between an amorphous polyester resin and a vinyl resin. In a preferred method for obtaining a reaction product between a vinyl resin and an amorphous polyester resin as such a hybrid resin, a polymerization reaction for either resin or both resins is carried out in the presence of a polymer that contains a monomer component that can react with each of the vinyl resin and amorphous polyester resin.

For example, among monomers that can constitute amorphous polyester resins, monomer that can react with vinyl resin can be exemplified by unsaturated dicarboxylic acids such as fumaric acid, maleic acid, citraconic acid, and itaconic acid and their anhydrides.

Among monomers that can constitute vinyl resins, monomer that can react with amorphous polyester resin can be exemplified by monomer that contains a carboxy group or hydroxy group and by acrylate esters and methacrylate esters.

As long as the main component is an amorphous polyester resin, a resin heretofore known for use in toners other than the aforementioned vinyl resin can be co-used in the amorphous resin.

This resin can be exemplified by phenolic resins, natural resin-modified phenolic resins, natural resin-modified maleic acid resins, acrylic resins, methacrylic resins, polyvinyl acetate resins, silicone resins, polyurethane, polyamide resins, furan resins, epoxy resins, xylene resins, polyvinyl butyral, terpene resins, coumarone-indene resins, and petroleum resins.

Viewed from the standpoint of the low-temperature fixability and the fixing release performance, the peak molecular weight (Mp) of the amorphous resin is preferably at least 3,500 and not more than 20,000.

Viewed from the standpoint of the charging stability in high-temperature, high-humidity environments, the acid value of the amorphous resin is preferably at least 5 mg KOH/g and not more than 30 mg KOH/g.

Viewed from the standpoint of the low-temperature fixability and the storability, the hydroxyl value of the amorphous resin is preferably at least 20 mg KOH/g and not more than 70 mg KOH/g.

From the standpoint of supporting the facile adjustment of $\eta_{0.01(A)}$ and $\eta_{0.69(A)}$ into the ranges indicated above, the peak molecular weight (Mp) of the amorphous polyester resin A is preferably at least 3,500 and not more than 7,000 and is more preferably at least 3,900 and not more than 7,000.

The acid value of the amorphous polyester resin A is preferably not more than 10 mg KOH/g from the standpoint of the charging stability in high-temperature, high-humidity environments.

A mixture of a high molecular weight amorphous polyester resin B with the low molecular weight amorphous polyester resin A may be used for the amorphous resin.

From the standpoint of the low-temperature fixability and fixing release performance, the content ratio (A:B) between the low molecular weight amorphous polyester resin A and the high molecular weight amorphous polyester resin B is preferably 30:70 to 85:15 on a mass basis.

The amorphous polyester resin B has a monomer unit derived from polyhydric alcohol and a monomer unit derived from polybasic carboxylic acid, and, viewed in terms of the fixing release performance, the content—in the monomer unit derived from polybasic carboxylic acid—of a monomer unit derived from at least one compound selected from the group consisting of tribasic and higher basic carboxylic acids and derivatives thereof is preferably at least 10.0 mol % and not more than 50.0 mol % and more preferably at least 15.0 mol % and not more than 30.0 mol %.

The peak molecular weight of the amorphous polyester resin B is preferably at least 8,000 and not more than 20,000 from the standpoint of the fixing release performance.

From the standpoint of the charging stability in high-temperature, high-humidity environments, the acid value of the amorphous polyester resin B is preferably at least 15 mg KOH/g and not more than 30 mg KOH/g.

The crystalline resin referenced above preferably contains crystalline polyester resin as its main component and more preferably is crystalline polyester resin. Here, main component means that the content of the crystalline polyester resin in the crystalline resin is at least 50 mass %. Other crystalline resins known for use in toners may be used in this crystalline resin to the extent that the characteristics of the crystalline polyester resin are not impaired.

This crystalline polyester resin contains a monomer unit derived from alcohol and a monomer unit derived from carboxylic acid. Moreover, crystalline resin is a resin for which an endothermic peak is observed in differential scanning calorimetric (DSC) measurement.

This crystalline polyester resin preferably contains a monomer unit derived from aliphatic diol having at least 2 and not more than 22 carbons and a monomer unit derived from aliphatic dicarboxylic acid having at least 2 and not more than 22 carbons.

Among these, from the standpoint of the low-temperature fixability and storability, the crystalline polyester resin more preferably contains a monomer unit derived from aliphatic diol having at least 6 and not more than 12 carbons and a monomer unit derived from aliphatic dicarboxylic acid having at least 6 and not more than 12 carbons.

The ready compatibility between the amorphous resin and the crystalline polyester resin is the reason why the low-temperature fixability of the toner is improved by the use of crystalline polyester resin for the crystalline resin. Due to the compatibility between the two resins, the space between the molecular chains of the amorphous resin widens and the intermolecular forces are weakened, resulting in a substantial decline in the glass transition temperature (Tg) of the amorphous resin and enabling the occurrence of a low melt viscosity.

That is, an improving trend for the low-temperature fixability is set up by increasing the compatibility between the amorphous resin and the crystalline polyester resin.

In order to increase the compatibility between the amorphous resin and the crystalline polyester resin, the ester group concentration and the polarity may be increased by using a lower number of carbons for the aliphatic diol and/or aliphatic dicarboxylic acid that constitute the crystalline polyester resin.

On the other hand, it is also necessary with a toner that has a substantially reduced Tg to secure the storability during, for example, use and transport in high-temperature, high-humidity environments. Due to this, when the toner is exposed to such an environment, preferably the compatibilized crystalline polyester resin in the toner undergoes recrystallization and the Tg of the toner is then returned to the original Tg of the amorphous resin.

Thus, when the crystalline polyester resin has a high ester group concentration and the compatibility between the amorphous resin and crystalline polyester is then too high, recrystallization of the crystalline polyester resin is inhibited and toner storability is likely to decline.

Based on the preceding, in order to bring about coexistence between the low-temperature fixability and the storability, this crystalline polyester resin more preferably contains a monomer unit derived from an aliphatic diol having at least 6 and not more than 12 carbons and a monomer unit derived from an aliphatic dicarboxylic acid having at least 6 and not more than 12 carbons.

There are no particular limitations on the aliphatic diol having at least 2 and not more than 22 carbons (more preferably at least 6 and not more than 12 carbons), but chain (more preferably straight-chain) aliphatic diols are preferred. The following are specific examples:

ethylene glycol, diethylene glycol, triethylene glycol, 1,2-propanediol, 1,3-propanediol, dipropylene glycol, 1,4-butanediol, 1,4-butadiene glycol, 1,5-pentanediol, neopentyl glycol, 1,6-hexanediol, 1,7-heptanediol, 1,8-octanediol, 1,9-nonanediol, 1,10-decanediol, 1,11-undecanediol, and 1,12-dodecanediol.

Preferred examples among the preceding are straight-chain aliphatic $\alpha,\omega$-diols such as 1,6-hexanediol, 1,7-heptanediol, 1,8-octanediol, 1,9-nonanediol, 1,10-decanediol, 1,11-undecanediol, and 1,12-dodecanediol.

Derivatives of these diols may be used as long as their condensation polymerization provides the same monomer unit structure. These derivatives can be exemplified by the esters of these diols.

In addition, the content—in the total alcohol component-derived monomer units constituting the crystalline polyester resin—of a monomer unit derived from at least one compound selected from the group consisting of aliphatic diols having at least 2 and not more than 22 carbons (more preferably at least 6 and not more than 12 carbons) and derivatives thereof is preferably at least 50 mass % and not more than 100 mass % and is more preferably at least 70 mass % and not more than 100 mass %.

A polyhydric alcohol other than the aforementioned aliphatic diol may also be used.

Among polyhydric alcohols, diols other than the aforementioned aliphatic diols can be exemplified by aromatic alcohols such as polyoxyethylenated bisphenol A and polyoxypropylenated bisphenol A; and by 1,4-cyclohexanedimethanol.

Among polyhydric alcohols, the trihydric and higher hydric polyhydric alcohols can be exemplified by aromatic alcohols such as 1,3,5-trihydroxymethylbenzene; and by aliphatic alcohols such as pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, and trimethylolpropane.

A monohydric alcohol may also be used to the extent that the characteristics of the crystalline polyester resin are not impaired. This monohydric alcohol can be exemplified by monoalcohols such as n-butanol, isobutanol, sec-butanol, n-hexanol, n-octanol, 2-ethylhexanol, cyclohexanol, and benzyl alcohol.

On the other hand, there are no particular limitations on the aliphatic dicarboxylic acid having at least 2 and not more than 22 carbons (more preferably at least 6 and not more than 12 carbons), but chain (preferably straight-chain) aliphatic dicarboxylic acids are preferred. The following are specific examples:

oxalic acid, malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, maleic acid, fumaric acid, mesaconic acid, citraconic acid, and itaconic acid.

Derivatives of the dicarboxylic acids may be used as long as their condensation polymerization provides the same monomer unit structure. Examples in this regard are dicarboxylic acid anhydrides and the alkyl esters and acid chlorides of dicarboxylic acids.

In addition, the content—in the total carboxylic acid component-derived monomer units constituting the crystalline polyester resin—of monomer units derived from at least one compound selected from the group consisting of aliphatic dicarboxylic acids having at least 2 and not more than 22 carbons (more preferably at least 6 and not more than 12 carbons) and derivatives thereof is preferably at least 50 mass % and not more than 100 mass % and is more preferably at least 70 mass % and not more than 100 mass %.

A polybasic carboxylic acid other than the aforementioned aliphatic dicarboxylic acids may also be used.

Among polybasic carboxylic acids, dibasic carboxylic acids other than the aforementioned aliphatic dicarboxylic acids can be exemplified by aromatic carboxylic acids such as isophthalic acid and terephthalic acid; aliphatic carboxylic acids such as n-dodecylsuccinic acid and n-dodecenylsuccinic acid; and alicyclic carboxylic acids such as cyclohexanedicarboxylic acid; wherein derivatives thereof, e.g., anhydrides and lower alkyl esters, are also included.

Among polybasic carboxylic acids, the tribasic and higher basic polybasic carboxylic acids can be exemplified by aromatic carboxylic acids such as 1,2,4-benzenetricarboxylic acid (trimellitic acid), 2,5,7-naphthalenetricarboxylic acid, 1,2,4-naphthalenetricarboxylic acid, and pyromellitic acid, and aliphatic carboxylic acids such as 1,2,4-butanetricarboxylic acid, 1,2,5-hexanetricarboxylic acid, and 1,3-dicarboxy-2-methyl-2-methylenecarboxypropane, wherein derivatives thereof, e.g., anhydrides and lower alkyl esters, are also included.

A monobasic carboxylic acid may also be used to the extent that the characteristics of the crystalline polyester resin are not impaired. This monobasic carboxylic acid can be exemplified by monocarboxylic acids such as benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, and octanoic acid.

Considered from the standpoint of the low-temperature fixability and the charging performance in high-temperature, high-humidity environments, the content of the crystalline polyester resin is preferably at least 3.0 mass parts and not more than 20.0 mass parts per 100 mass parts of the amorphous resin.

From the standpoint of the low-temperature fixability and the storability, the crystalline polyester resin may have, in molecular chain terminal position, a monomer unit derived from one or more aliphatic compounds (also referred to herebelow as a nucleating agent) selected from the group consisting of aliphatic monocarboxylic acids and aliphatic monoalcohols that have at least 10 and not more than 20 carbons.

With regard to the crystalline component of the crystalline polyester resin in the toner, generally crystal nuclei are formed followed by crystal growth. By placing the aforementioned nucleating agent segment in molecular chain terminal position on the crystalline polyester resin, this becomes a crystal nucleus and recrystallization can then be accelerated and the storability is improved as a consequence.

When the number of carbons is in the indicated range, condensation in molecular chain terminal position is also easily brought about and the free monomer is then not present, making this preferred from the standpoint of the storability.

There is also no loss of the compatibility between the crystalline polyester resin and the amorphous polyester resin when the number of carbons is in the indicated range, making this preferred also from the standpoint of the low-temperature fixability.

The content of the monomer unit derived from this aliphatic compound, with reference to the total monomer units constituting the crystalline polyester resin, is preferably at least 1.0 mol % and not more than 10.0 mol % and is more preferably at least 4.0 mol % and not more than 8.0 mol %. The content of the aliphatic compound-derived monomer unit is preferably in the indicated range because there is then no impairment of the low-temperature fixability and a suitable amount of nucleating agent is also caused to be present.

The aliphatic monocarboxylic acid having at least 10 and not more than 20 carbons can be exemplified by capric acid (decanoic acid), undecanoic acid, lauric acid (dodecanoic acid), tridecanoic acid, myristic acid (tetradecanoic acid), pentadecanoic acid, palmitic acid (hexadecanoic acid), margaric acid (heptadecanoic acid), stearic acid (octadecanoic acid), nonadecanoic acid, and arachidic acid (eicosanoic acid).

The aliphatic monoalcohol having at least 10 and not more than 20 carbon atoms can be exemplified by capric alcohol (decanol), undecanol, lauryl alcohol (dodecanol), tridecanol, myristyl alcohol (tetradecanol), pentadecanol, palmityl alcohol (hexadecanol), margaryl alcohol (heptadecanol), stearyl alcohol (octadecanol), nonadecanol, and arachidyl alcohol (eicosanol).

The crystalline polyester resin can be produced using common methods of polyester synthesis. For example, the crystalline polyester resin can be obtained by carrying out an esterification reaction or transesterification reaction between the above-described carboxylic acid and alcohol followed by reducing the pressure or introducing nitrogen gas and carrying out a polycondensation reaction according to a common method. In addition, the aforementioned nucleating agent may be added to the resulting crystalline polyester resin and an esterification reaction may then be run to provide a crystalline polyester resin having the nucleating agent in molecular chain terminal position.

This esterification reaction or transesterification reaction may as necessary be carried out using a common esterification catalyst or transesterification catalyst, e.g., sulfuric acid, titanium butoxide, dibutyltin oxide, tin 2-ethylhexanoate, manganese acetate, and magnesium acetate.

The polycondensation reaction can be carried out using a known catalyst, e.g., a common polymerization catalyst, for example, titanium butoxide, dibutyltin oxide, tin 2-ethylhexanoate, tin acetate, zinc acetate, tin disulfide, antimony trioxide, and germanium dioxide. The polymerization temperature and amount of catalyst are not particularly limited and may be determined as appropriate.

In order to raise the strength of the resulting crystalline polyester resin, a method may be used in the esterification reaction, transesterification reaction, or polycondensation reaction such as, e.g., charging all the monomer all at once, or first reacting the divalent monomer in order to bring the low molecular weight component to low levels and thereafter adding the trivalent and higher valent monomer and reacting.

The toner particle may contain a polymer (also referred to below simply as the "graft polymer") in which styrene-acrylic polymer is graft polymerized on polyolefin.

The incorporation of the graft polymer makes it possible to bring about a finer dispersion of the crystalline resin and is thus preferred from the standpoint of improving the low-temperature fixability of the toner.

The crystalline polyester resin, being an ester compound from a long-chain hydrocarbon diol and dicarboxylic acid, is positioned, among the constituent substances of the toner, at an intermediate polarity between the release agent and the amorphous resin. Moreover, because it is constituted of a long-chain hydrocarbon diol and dicarboxylic acid, it tends to readily exhibit affinity for aliphatic hydrocarbon compounds.

That is, the use of the graft polymer makes it possible to bring about a finer dispersion of the crystalline polyester resin and thus makes it possible to bring about additional improvements in the low-temperature fixability.

Moreover, through the use of the graft polymer, the dispersion of the release agent is also further improved and outmigration of the release agent during fixing is promoted and the fixing release performance is then also further enhanced.

The content of the graft polymer is preferably at least 3.0 mass parts and not more than 8.0 mass parts per 100 mass parts of the amorphous resin.

A microfine dispersion of the crystalline polyester resin in the amorphous resin is more efficiently implemented when the content of the graft polymer is in the indicated range.

The polyolefin is not particularly limited other than that it is a polymer or copolymer of an unsaturated hydrocarbon having a single double bond, and a variety of polyolefins can be used. For example, low molecular weight polyethylene and low molecular weight polypropylene are preferred.

This polyolefin preferably has a peak temperature for its maximum endothermic peak, as measured using a differential scanning calorimeter (DSC), of approximately at least 70° C. and not more than 90° C.

The mass ratio in the graft polymer of the polyolefin to the styrene-acrylic polymer is preferably 1:99 to 30:70 and is more preferably 3:97 to 20:80.

The styrene-acrylic polymer here preferably contains a monomer unit derived from a saturated alicyclic compound. Through the incorporation of a saturated alicyclic compound-derived monomer unit, the hydrophobicity of the graft polymer is increased further, the affinity with the crystalline polyester resin is increased, and the microdispersing effect for the crystalline polyester resin is further enhanced.

The saturated alicyclic compound can be exemplified by cyclopropyl acrylate, cyclobutyl acrylate, cyclopentyl acrylate, cyclohexyl acrylate, cycloheptyl acrylate, cyclooctyl acrylate, cyclopropyl methacrylate, cyclobutyl methacrylate, cyclopentyl methacrylate, cyclohexyl methacrylate, cycloheptyl methacrylate, cyclooctyl methacrylate, dihydrocyclopentadiethyl acrylate, dicyclopentenyl acrylate, dicyclopentenyloxyethyl acrylate, dicyclopentanyl acrylate, dicyclopentenyloxyethyl methacrylate, and dicyclopentanyl methacrylate.

Among the preceding, cyclohexyl acrylate, cycloheptyl acrylate, cyclooctyl acrylate, cyclohexyl methacrylate, cycloheptyl methacrylate, and cyclooctyl methacrylate are preferred from the standpoint of the hydrophobicity.

The content of the saturated alicyclic compound-derived monomer unit, in the total monomer units constituting the graft polymer, is preferably at least 1.0 mol % and not more than 40.0 mol % and is more preferably at least 3.0 mol % and not more than 15.0 mol %.

Constituent components of the styrene-acrylic polymer—other than the saturated alicyclic compounds described above—can be exemplified by the following monomers:

styrenic monomer such as styrene, α-methylstyrene, p-methylstyrene, m-methylstyrene, p-methoxystyrene, p-hydroxystyrene, p-acetoxystyrene, vinyltoluene, ethylstyrene, phenylstyrene, and benzylstyrene; alkyl esters (wherein the number of carbons in the alkyl is at least 1 and not more than 18) of unsaturated carboxylic acids such as methyl acrylate, ethyl acrylate, butyl acrylate, 2-ethylhexyl acrylate, methyl methacrylate, ethyl methacrylate, butyl methacrylate, and 2-ethylhexyl methacrylate; vinyl ester monomers such as vinyl acetate; vinyl ether monomers such as vinyl methyl ether; vinyl monomers that contain a halogen element, such as vinyl chloride; and diene monomers such as butadiene and isobutylene. A single one of these may be used or two or more may be used in combination.

The content of the styrenic monomer-derived monomer unit, in the total monomer units constituting the graft polymer, is preferably at least 60.0 mol % and not more than 90.0 mol % and is more preferably at least 70.0 mol % and not more than 85.0 mol %.

The proportion of the monomer unit derived from an alkyl ester of an unsaturated carboxylic acid, in the total monomer units constituting the graft polymer, is preferably at least 5.0 mol % and not more than 30.0 mol % and is more preferably at least 10.0 mol % and not more than 20.0 mol %.

The peak molecular weight of the graft polymer is preferably at least 5,000 and not more than 70,000 and is more preferably at least 6,000 and not more than 50,000.

The softening point of the graft polymer is preferably at least 100° C. and not more than 150° C. and is more preferably at least 110° C. and not more than 135° C.

The method for carrying out the graft polymerization of the styrene-acrylic polymer on the polyolefin is not particularly limited, and heretofore known methods can be used.

The toner particle contains a release agent. This release agent can be exemplified by the following:

hydrocarbon waxes such as low molecular weight polyethylene, low molecular weight polypropylene, alkylene copolymers, microcrystalline wax, paraffin wax, and Fischer-Tropsch waxes; oxides of hydrocarbon waxes, such as oxidized polyethylene wax, and their block copolymers; waxes in which the major component is fatty acid ester, such as carnauba wax; and waxes provided by the partial or complete deacidification of fatty acid esters, such as deacidified carnauba wax. Additional examples are as follows: saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; esters between a fatty acid, e.g., palmitic acid, stearic acid, behenic acid, montanic acid, and so forth, and an alcohol such as stearyl alcohol, aralkyl alcohols, behenyl alcohol, carnaubyl alcohol, ceryl alcohol, melissyl alcohol, and so forth; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; partial esters between a polyhydric alcohol and a fatty acid, such as behenic monoglyceride; and hydroxy group-containing methyl ester compounds obtained by the hydrogenation of plant oils.

Among these waxes, the following are preferred from the standpoint of improving the low-temperature fixability and fixing release performance: hydrocarbon waxes such as paraffin waxes and Fischer-Tropsch waxes, and fatty acid ester waxes such as carnauba wax.

In addition, the peak temperature of the maximum endothermic peak of the release agent, in the endothermic curve measured using a differential scanning calorimeter (DSC) during temperature ramp up, is preferably at least 45° C. and not more than 140° C.

The peak temperature of the maximum endothermic peak for the release agent is preferably in the indicated range because this enables the storability of the toner to coexist with its hot offset resistance.

The content of the release agent in the toner is preferably at least 2.0 mass % and not more than 8.0 mass %, more preferably at least 3.0 mass % and not more than 6.0 mass %, and even more preferably at least 3.0 mass % and not more than 5.0 mass %.

When the release agent content is in the indicated range, the release agent in the vicinity of the toner surface can be brought to low levels and as a consequence a higher transferability is obtained even during long-term image output. On the other hand, the release agent can outmigrate during fixing and can lower the interfacial attachment force with the fixing roller, and as a result an even better fixing release performance is obtained.

The toner particle contains a colorant. This colorant can be exemplified as follows.

The black colorants can be exemplified by carbon black; and by black colorants obtained by color mixing using a yellow colorant, magenta colorant, and cyan colorant to give a black color. A pigment may be used by itself for the colorant, but the enhanced sharpness provided by the co-use of a dye with a pigment is more preferred from the standpoint of the image quality of full-color images.

Pigments for magenta toners can be exemplified by C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; and C.I. Vat Red 1, 2, 10, 13, 15, 23, 29, and 35.

Dyes for magenta toners can be exemplified by oil-soluble dyes such as C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39, and 40 and C.I. Basic Violet 1, 3, 7, 10, 14, 15, 21, 25, 26, 27, and 28.

Pigments for cyan toners can be exemplified by C.I. Pigment Blue 2, 3, 15:2, 15:3, 15:4, 16, and 17; C.I. Vat Blue 6; C.I. Acid Blue 45; and copper phthalocyanine pigments having 1 to 5 phthalimidomethyl groups substituted on the phthalocyanine skeleton.

C.I. Solvent Blue 70 is an example of a dye for cyan toners.

Pigments for yellow toners can be exemplified by C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185 and by C.I. Vat Yellow 1, 3, and 20.

C.I. Solvent Yellow 162 is an example of a dye for yellow toners.

The colorant content is preferably at least 0.1 mass parts and not more than 30.0 mass parts per 100 mass parts of the amorphous resin.

The toner may as necessary also contain a charge control agent. Known charge control agents can be used as the charge control agent incorporated in the toner, but metal compounds of aromatic carboxylic acids that are colorless, support a rapid toner charging speed, and enable the stable maintenance of a certain charge quantity are particularly preferred.

Negative-charging charge control agents can be exemplified by metal salicylate compounds, metal naphthoate compounds, metal dicarboxylate compounds, polymer compounds having sulfonic acid or carboxylic acid in side chain position, polymer compounds having sulfonate salt or sulfonate ester in side chain position, polymer compounds having carboxylate salt or carboxylate ester in side chain position, boron compounds, urea compounds, silicon compounds, and calixarene.

Positive-charging charge control agents can be exemplified by quaternary ammonium salts, polymer compounds having such quaternary ammonium salts in side chain position, guanidine compounds, and imidazole compounds.

The charge control agent may be internally added or externally added to the toner particle. The content of the charge control agent is preferably at least 0.2 mass parts and not more than 10.0 mass parts per 100 mass parts of the amorphous resin.

The toner may as necessary contain inorganic fine particles.

The inorganic fine particles may be internally added to the toner particle or may be mixed with the toner particle as an external additive.

Inorganic fine particles such as silica fine particles, titanium oxide fine particles, and aluminum oxide fine particles are preferred as external additives. The inorganic fine particles are preferably hydrophobed with a hydrophobic agent such as a silane compound, a silicone oil, or a mixture thereof.

When used as an external additive in order to improve the flowability, inorganic fine particles having a specific surface area of at least 50 $m^2/g$ and not more than 400 $m^2/g$ are preferred; in order to stabilize the durability, inorganic fine particles having a specific surface area of at least 10 $m^2/g$ and not more than 50 $m^2/g$ are preferred. Combinations of inorganic fine particles having specific surface areas in the indicated ranges may be used in order to bring about co-existence between flowability improvement and stabilization of the durability.

The content of this external additive is preferably at least 0.1 mass parts and not more than 10.0 mass parts per 100 mass parts of the toner particle. A known mixer, such as a Henschel mixer, can be used to mix the toner particle with the external additive.

The toner of the present invention may also be used as a single-component developer, but from the standpoint of obtaining a consistent image on a long-term basis, it is preferably mixed with a magnetic carrier and used as a two-component developer.

A commonly known magnetic carrier can be used for this magnetic carrier, for example, iron oxide; metal particles of, e.g., iron, lithium, calcium, magnesium, nickel, copper, zinc, cobalt, manganese, chromium, or a rare earth, as well as alloy particles of the preceding and oxide particles of the preceding; magnetic bodies such as ferrite; and magnetic body-dispersed resin carriers (known as resin carriers), which contain a magnetic body and a binder resin that holds this magnetic body in a dispersed state.

With regard to the mixing proportion for the magnetic carrier when the toner is used mixed with a magnetic carrier as a two-component developer, at least 2 mass % and not more than 15 mass % is preferred for the toner concentration in the two-component developer while at least 4 mass % and not more than 13 mass % is more preferred.

A toner production method is described in the following, but the toner production method is not limited to or by the following.

The pulverization method is an example of a toner production method, wherein a resin composition containing the amorphous resin, colorant, release agent, and crystalline resin and optional additional substances is subjected to melt-kneading and the resulting kneaded material is cooled and then pulverized and classified.

The toner production procedure in the pulverization method is as follows.

The materials that will constitute the toner particle, i.e., the amorphous resin, colorant, release agent, and crystalline resin and the additional optional components such as a prescribed graft polymer and charge control agent, are metered out in prescribed amounts and are blended and mixed to obtain a resin composition.

The mixing apparatus can be exemplified by a double cone mixer, V-mixer, drum mixer, Supermixer, Henschel mixer, Nauta mixer, and Mechano Hybrid (Nippon Coke & Engineering Co., Ltd.).

The resin composition is then melt-kneaded and the colorant, release agent, crystalline resin and the like are thereby dispersed in the amorphous resin.

A batch kneader, e.g., a pressure kneader or Banbury mixer, or a continuous kneader can be used in the aforementioned melt-kneading step, and single-screw extruders and twin-screw extruders are the mainstream here because they offer the advantage of enabling continuous production. Examples here are the Model KTK twin-screw extruder (Kobe Steel, Ltd.), Model TEM twin-screw extruder (Toshiba Machine Co., Ltd.), PCM kneader (Ikegai Ironworks Corp.), Twin Screw Extruder (KCK), Co-Kneader (Buss), and Kneadex (Nippon Coke & Engineering Co., Ltd.).

The kneaded material yielded by melt-kneading is rolled out using, for example, a two-roll mill, and is cooled using, for example, water. The resulting cooled material is pulverized to a desired particle diameter using the following means to obtain resin particles.

For example, a coarse pulverization may be performed using a grinder such as a crusher, hammer mill, or feather mill, followed, for example, by a fine pulverization using a fine pulverizer such as a Kryptron System (Kawasaki Heavy Industries, Ltd.), Super Rotor (Nisshin Engineering Inc.), or Turbo Mill (Turbo Kogyo Co., Ltd.) or using an air jet system.

This may as necessary be followed by classification using a sieving apparatus or a classifier, e.g., an inertial classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

Toner particles may be obtained by executing a heat treatment on the resulting resin particles. From the standpoint of the low-temperature fixability and fixing release performance, this heat treatment is preferably a treatment with a hot air current.

A specific example is given in the following of a method for executing a heat treatment on the resin particles using the heat-treatment apparatus shown in FIG. 1.

With the heat-treatment apparatus shown in FIG. 1, the resin particles are instantaneously melted using a hot air current and are quenched subsequent to this. By doing this, during toner use in a normal-temperature, normal-humidity environment, a state can be maintained in which the crystalline resin and amorphous resin are compatibilized and as a consequence a maximum plasticizing effect can be brought out and the low-temperature fixability can be improved. In addition, because the heat treatment is performed in a hydrophobic space in the air, the release agent, which is a constituent component of the toner, transfers to near the vicinity of the toner surface and as a consequence the outmigration of the release agent during fixing is promoted and the fixing release performance is then also improved.

The average circularity of the toner particle can also be increased by this heat treatment.

The resin particles, which are metered and fed by a starting material metering and feed means 1, are conducted, by a compressed gas adjusted by a compressed gas flow rate adjustment means 2, to an introduction tube 3 that is disposed on the vertical line of a starting material feed means. The resin particles that have passed through the introduction tube 3 are uniformly dispersed by a conical projection member 4 that is disposed at the center of the starting material feed means and are introduced into an eight-direction feed tube 5 that extends radially and are introduced into a treatment compartment 6 in which the heat treatment is performed.

At this point, the flow of the resin particles fed into the treatment compartment 6 is regulated by a regulation means 9 that is disposed within the treatment compartment 6 in order to regulate the flow of the resin particles. As a result, the resin particles fed into the treatment compartment 6 are heat treated while rotating within the treatment compartment 6 and are thereafter cooled.

The hot air current for carrying out the heat treatment of the introduced resin particles is itself fed from a hot air current feed means 7 and is distributed by a distribution member 12, and the hot air current is introduced into the treatment compartment 6 having been caused to undergo a spiral rotation by a rotation member 13 for imparting rotation to the hot air current. With regard to its structure, the rotation member 13 for imparting rotation to the hot air current has a plurality of blades, and the rotation of the hot air current can be controlled using their number and angle (11 shows a hot air current feed means outlet). The hot air current fed into the treatment compartment 6 has a temperature at the outlet of the hot air current feed means 7 preferably of 100° C. to 300° C. When the temperature at the outlet of the hot air current feed means 7 resides in the indicated range, the particles can be uniformly treated while the melt adhesion and coalescence of the particles that would be induced by an excessive heating of the resin particles is prevented.

A hot air current is fed from the hot air current feed means 7. In addition, the heat-treated resin particles that have been heat treated are cooled by a cold air current fed from a cold air current feed means 8. The temperature of the cold air current fed from the cold air current feed means 8 is preferably between −20° C. and 30° C. When the cold air current temperature resides in this range, the heat-treated resin particles can be efficiently cooled and melt adhesion and coalescence of the heat-treated resin particles can be prevented without impairing the uniform heat treatment of the resin particles. The absolute amount of moisture in the cold air current is preferably at least 0.5 $g/m^3$ and not more than 15.0 $g/m^3$.

The cooled heat-treated resin particles are then recovered by a recovery means 10 residing at the lower end of the treatment compartment 6. A blower (not shown) is disposed at the end of the recovery means 10 and thereby forms a structure that carries out suction transport.

In addition, a powder particle feed port 14 is disposed so the rotational direction of the incoming resin particles is the same direction as the rotational direction of the hot air current, and the recovery means 10 is also disposed tangentially to the periphery of the treatment compartment 6 so as to maintain the rotational direction of the rotating resin particles. In addition, the cold air current fed from the cold air current feed means 8 is configured to be fed from a horizontal and tangential direction from the periphery of the apparatus to the circumferential surface within the treatment compartment. The rotational direction of the pre-heat-treatment resin particles fed from the powder particle feed port 14, the rotational direction of the cold air current fed from the cold air current feed means 8, and the rotational direction of the hot air current fed from the hot air current feed means 7 are all the same direction. As a consequence, flow perturbations within the treatment compartment 6 do not occur; the rotational flow within the apparatus is reinforced; a strong centrifugal force is applied to the resin particles prior to the heat treatment; and the dispersity of the resin particles prior to the heat treatment is further enhanced, as a result of which there are few coalesced particles and heat-treated resin particles with a uniform shape can be obtained.

The average circularity of the toner is preferably at least 0.950 and not more than 0.980 because this makes it possible to increase the transferability and supports coexistence of the cleaning performance.

The methods used to measure the various properties of the toner and starting materials are described in the following.

<Method for Measuring the Extensional Viscosity of the Amorphous Resin and the Toner>

The extensional viscosity of the amorphous resin and the toner is measured using an "ARES G2" (TA Instruments) viscoelastic measurement apparatus (rheometer). For this extensional viscosity, the uniaxial extensional viscosity is measured using the measurement tool described below.

The measurement conditions are as follows.

uniaxial extensional viscosity measurement tool: ARES-EVF measurement sample: Using a hot-press molder, the amorphous resin or toner is molded into a rectangular parallelepiped having a width of 10 mm, a length of 30 mm, and a thickness of 1 mm. In addition, this sample is thoroughly melted and is held at 10 MPa for 1 minute using a temperature condition at which the bubbles escape. A miniTEST PRESS-10 from Toyo Seiki Seisaku-sho, Ltd. is used for the hot press molder.

The aforementioned measurement tool and sample are held for 1 hour at normal temperature (23° C.), after which the sample is placed in the measurement tool. The temperature is then adjusted over 5 minutes to the 90° C. measurement start temperature, after which the measurement is run using the following settings.

(Geometries)

Width: 10 mm

Thickness: 1 mm

Stress Constant: 12265.4 Pa/g·cm

Strain Constant: 0.811024 1/rad (Conditioning)

Configuration: Override

Normal force transducer mode: Spring

Torque transducer mode: FRT (Other Extensional)

Final strain: 3

Extension rate: 0.3

Sampling: 50 (Log)

The data is transmitted via the interface to TRIOS "control, data collection, and analysis software" from TA Instruments running on Windows (registered trademark) 7 from the Microsoft Corporation. The value of the viscosity at a Hencky strain of 0.01 and the value of the viscosity at a Hencky strain of 0.69 are acquired from this.

Figure 2:
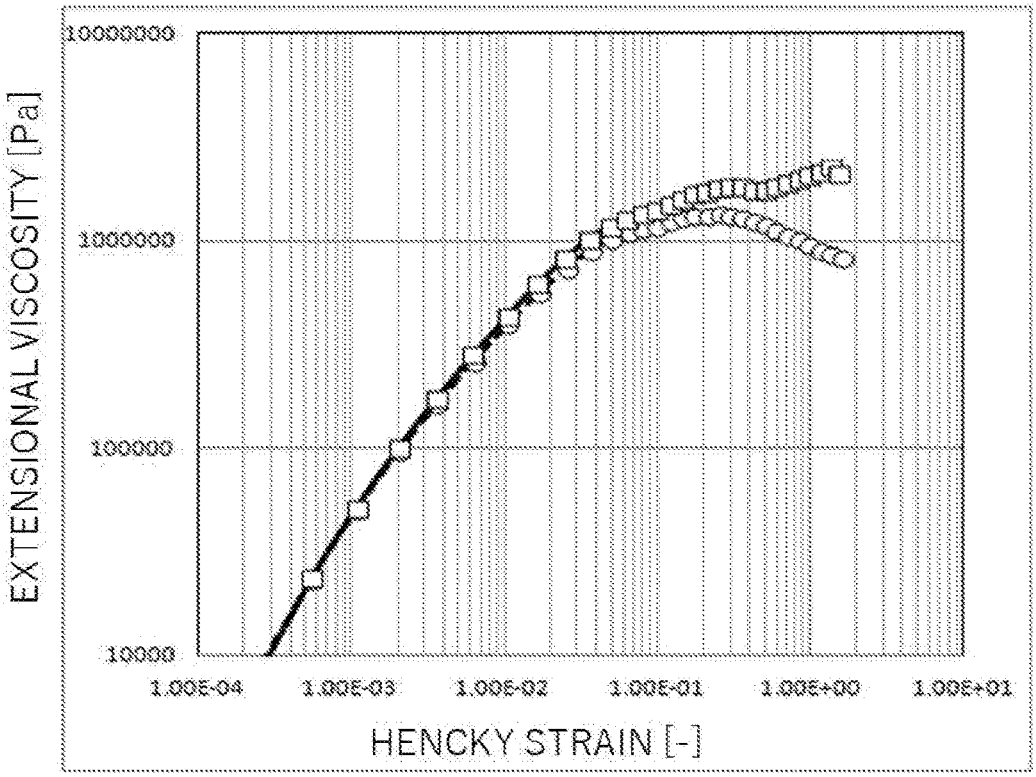
FIG. 2 is an example of samples that have different strain hardening behaviors.

An example of the relationship between the Hencky strain and the extensional viscosity (for samples having different strain hardening profiles) is shown in FIG. 2.

(Method for Measuring the Extensional Viscosity of the Amorphous Polyester Resin A in the Toner)

The measurement should be performed after the amorphous polyester resin has been separated from the toner utilizing differences in solvent solubility.

The amorphous polyester resin is separated from the toner using the following procedure.

The toner is dissolved in methyl ethyl ketone (MEK) at 23° C. and is thereby separated into soluble matter (amorphous polyester resin) and insoluble matter (e.g., crystalline resin, release agent, colorant, and inorganic fine particles).

<Method for Measuring the Peak Molecular Weight (Mp) of the Crystalline Resin>

The peak molecular weight of the crystalline resin is measured proceeding as follows using gel permeation chromatography (GPC).

First, the crystalline resin is dissolved in o-dichlorobenzene over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to an o-dichlorobenzene-soluble component concentration of approximately 0.1 mass %. The measurement is performed under the following conditions using this sample solution.

instrument: HLC-8121GPC/HT (Tosoh Corporation)

columns: 2×TSKgel GMHHR-H HT (7.8 cm I.D.×30 cm) (Tosoh Corporation)

detector: high-temperature RI temperature: 135° C.

eluent: o-dichlorobenzene (with 0.05% IONOL added)

flow rate: 1.0 mL/min sample: 0.4 mL of the 0.1% sample is injected

A molecular weight calibration curve constructed using monodisperse polystyrene standard samples is used for calculation of the molecular weight of the sample. Moreover, calculation as polyethylene is performed using a conversion formula derived from the Mark-Houwink viscosity equation.

<Method for Measuring the Peak Molecular Weight (Mp) of the Amorphous Resin and the Graft Polymer>

The peak molecular weight of the amorphous resin and the graft polymer (polymer in which styrene-acrylic polymer is graft polymerized on polyolefin) is measured proceeding as follows using gel permeation chromatography (GPC).

First, the sample is dissolved in tetrahydrofuran (THF) over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to a THF-soluble component concentration of approximately 0.8 mass %. The measurement is performed under the following conditions using this sample solution.

instrument: HLC8120 GPC (detector: RI) (Tosoh Corporation)
columns: 7-column train of Shodex KF-801, 802, 803, 804, 805, 806, and 807 (Showa Denko K.K.)
eluent: tetrahydrofuran (THF)
flow rate: 1.0 mL/min
oven temperature: 40.0° C.
sample injection amount: 0.10 mL The molecular weight calibration curve used to determine the molecular weight of the sample is constructed using polystyrene resin standards (product name: "TSK Standard Polystyrene F-850, F-450, F-288, F-128, F-80, F-40, F-20, F-10, F-4, F-2, F-1, A-5000, A-2500, A-1000, A-500", Tosoh Corporation).

<Method for Measuring the Softening Point (Tm) of the Amorphous Resin, the Graft Polymer, and the Toner>

Using a "Flowtester CFT-500D Flow Property Evaluation Instrument" constant-load extrusion-type capillary rheometer (Shimadzu Corporation), the softening point is measured according to the manual provided with the instrument.

With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature can be obtained from this.

The "melting temperature by the ½ method", as described in the manual provided with the "Flowtester CFT-500D Flow Property Evaluation Instrument", is used as the softening point in the present invention.

The melting temperature by the ½ method is determined as follows.

First, ½ of the difference between Smax, which is the piston stroke at the completion of outflow, and Smin, which is the piston stroke at the start of outflow, is determined (this value is designated as X, where X=(Smax−Smin)/2). The temperature of the flow curve when the piston stroke in the flow curve reaches X is the melting temperature by the ½ method.

The measurement sample used is prepared by subjecting approximately 1.0 g of the sample to compression molding for approximately 60 seconds at approximately 10 MPa in a 25° C. environment using a tablet compression molder (for example, NT-100H, NPa System Co., Ltd.) to provide a cylindrical shape with a diameter of approximately 8 mm.

The measurement conditions with the CFT-500D are as follows.

test mode: ramp-up method
start temperature: 50° C.
saturated temperature: 200° C.
measurement interval: 1.0° C.
ramp rate: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm <Method for Measuring the Glass Transition Temperature (Tg) of the Amorphous Resin and Toner>

The glass transition temperature is measured based on ASTM D 3418-82 using a "Q2000" (TA Instruments) differential scanning calorimeter.

Temperature correction in the instrument detection section uses the melting points of indium and zinc, and correction of the amount of heat uses the heat of fusion of indium.

Specifically, approximately 3 mg of the sample is exactly weighed out and this is introduced into an aluminum pan, and the measurement is run under the following conditions using an empty aluminum pan as reference.

ramp rate: 10° C./min
measurement start temperature: 30° C.
measurement end temperature: 180° C.

The measurement is carried out at a ramp rate of 10° C./min in the measurement range of 30° C. to 180° C. The measurement is carried out by initially raising the temperature to 180° C., holding for 10 minutes, then cooling to 30° C., and subsequently reheating.

The change in the specific heat in the 30° C. to 100° C. temperature range in this second ramp-up process is obtained. When this is done, the glass transition temperature (Tg) is taken to be the point at the intersection between the differential heat curve and the line for the midpoint for the baselines for prior to and subsequent to the appearance of the change in the specific heat.

<Method for Measuring the Melting Point of the Crystalline Resin>

The melting point of the crystalline resin is measured based on ASTM D 3418-82 using a "Q2000" (TA Instruments) differential scanning calorimeter.

Temperature correction in the instrument detection section uses the melting points of indium and zinc, and correction of the amount of heat uses the heat of fusion of indium.

Specifically, approximately 3 mg of the sample is exactly weighed out and this is introduced into an aluminum pan, and the measurement is run under the following conditions using an empty aluminum pan as reference.

ramp rate: 10° C./min
measurement start temperature: 30° C.
measurement end temperature: 180° C.

The measurement is carried out at a ramp rate of 10° C./min in the measurement temperature range of 30° C. to 180° C.

In the measurement, the sample is heated from 30° C. to 180° C. at a ramp rate of 10° C./min, is then cooled to 30° C. from 180° C. at a ramp down rate of 10° C./min, and is subsequently reheated from 30° C. to 180° C. at a ramp rate of 10° C./min.

The peak temperature of the maximum endothermic peak in the differential scanning calorimetric curve in the 30° C. to 180° C. temperature range in the second ramp-up process is taken to be the melting point [unit: ° C.].

<Method for Measuring the Weight-Average Particle Diameter (D4) of the Toner>

Using a "Coulter Counter Multisizer 3" (registered trademark, Beckman Coulter, Inc.), a precision particle size distribution measurement instrument operating on the pore electrical resistance method and equipped with a 100 μm aperture tube, and the accompanying dedicated software, i.e., "Beckman Coulter Multisizer 3 Version 3.51" (Beckman Coulter, Inc.), for setting the measurement conditions and analyzing the measurement data, the weight-average particle diameter (D4) of the toner is determined by performing the measurement in 25,000 channels for the number of effective measurement channels and analyzing the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to at least 2 μm and not more than 60 μm.

The specific measurement procedure proceeds as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are removed using the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W and equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is adjusted as appropriate during ultrasound dispersion to be at least 10° C. and not more than 40° C.

(6) Using a pipette, the aqueous electrolyte solution prepared in (5), in which toner is dispersed, is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

<Method for Measuring the Average Circularity of the Toner>

The average circularity of the toner is measured using an "FPIA-3000" (Sysmex Corporation), a flow-type particle image analyzer, and using the measurement and analysis conditions from the calibration process.

The specific measurement method is as follows.

First, approximately 20 mL of deionized water from which solid impurities and so forth have been preliminarily removed, is introduced into a glass container. To this is added as dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

Approximately 0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be at least 10° C. and not more than 40° C. Using a benchtop ultrasound cleaner/disperser that has an oscillation frequency of 50 kHz and an electrical output of 150 W ("VS-150" (Velvo-Clear Co., Ltd.)) as the ultrasound disperser, a prescribed amount of deionized water is introduced into the water tank and approximately 2 mL of Contaminon N is added to the water tank.

The previously cited flow particle image analyzer fitted with a standard objective lens (10×) is used for the measurement, and "PSE-900A" (Sysmex Corporation) particle sheath is used for the sheath solution. The dispersion prepared according to the procedure described above is introduced into the flow particle image analyzer and 3,000 toner particles are measured according to total count mode in HPF measurement mode.

The average circularity of the toner is determined with the binarization threshold value during particle analysis set at 85% and the analyzed particle diameter set to a circle-equivalent diameter of at least 1.98 μm and not more than 39.96 μm.

For this measurement, automatic focal point adjustment is performed prior to the start of the measurement using reference latex particles (for example, a dilution with deionized water of "RESEARCH AND TEST PARTICLES Latex Microsphere Suspensions 5200A", Duke Scientific). After this, focal point adjustment is preferably performed every two hours after the start of measurement.

<Method for Separating the Amorphous Resin, Crystalline Resin, and Release Agent from the Toner>

The individual substances can be separated from the toner utilizing differences in solvent solubility.

Separation of the individual substances from the toner is carried out using the following procedure.

First separation: the toner is dissolved in methyl ethyl ketone (MEK) at 23° C. and the soluble matter (amorphous resin) is separated from the insoluble matter (crystalline resin, release agent, colorant, inorganic fine particles, and so forth).

Second separation: the insoluble matter (crystalline resin, release agent, colorant, inorganic fine particles) yielded by the first separation is dissolved in 100° C. MEK and the soluble matter (crystalline resin, release agent) is separated from the insoluble matter (colorant, inorganic fine particles).

Third separation: the soluble matter (crystalline resin, release agent) yielded by the second separation is dissolved in 23° C. chloroform and the soluble matter (crystalline resin) is separated from the insoluble matter (release agent).

EXAMPLES

The present invention is more specifically described in the following using production examples and examples, but these in no way limit the present invention. Unless specifically indicated otherwise, the number of parts and % for the following blends are on a mass basis in all instances.

Amorphous Polyester Resin A1 Production Example

| | |
|---|---|
| polyoxypropylene(2.2)-2,2-bis(4-hydroxyphenyl)propane (0.18 moles, 100.0 mol % with reference to the total number of moles of polyhydric alcohol) | 71.5 parts |
| terephthalic acid (0.08 moles, 50.0 mol % with reference to the total number of moles of polybasic carboxylic acid) | 12.6 parts |
| titanium tetrabutoxide (esterification catalyst) | 0.5 parts |
| trimellitic anhydride (0.05 moles, 50.0 mol % with reference to the total number of moles of polybasic carboxylic acid) | 16.0 parts |
| tert-butylcatechol (polymerization inhibitor) | 0.1 parts |

These substances were weighed into a reaction vessel fitted with a condenser, stirrer, nitrogen introduction line, and thermocouple.

The interior of the reaction vessel was subsequently substituted with nitrogen gas; the temperature was then gradually raised while stirring; and a reaction was run for 4 hours while stirring at a temperature of 200° C.

The pressure within the reaction vessel was dropped to 8.3 kPa; holding was carried out for 1 hour; and then cooling to 160° C. and return to atmospheric pressure were performed (first reaction process).

These substances were then added and the pressure within the reaction vessel was dropped to 8.3 kPa and the temperature was held at 180° C. and a reaction was carried out for 1 hour in this condition. After confirming that the softening point, as measured in accordance with ASTM D 36-86, had reached 90° C., the temperature was lowered and the reaction was stopped (second reaction process), thereby yielding resin A1.

The resulting amorphous polyester resin A1 had a peak molecular weight (Mp) of 5,000, a softening point (Tm) of 90° C., a glass transition temperature (Tg) of 54° C., an extensional viscosity $\eta_{0.01(A)}$ of $4.2\times10^5$ Pa, an extensional viscosity $\eta_{0.69(A)}$ of $1.8\times10^6$ Pa, and a ratio $\eta_{0.69(A)}/\eta_{0.01(A)}$ of 4.3.

Amorphous Polyester Resins A2 to A29 Production Example

Amorphous polyester resins A2 to A29 were obtained by running a reaction proceeding as in the Amorphous Polyester Resin A1 Production Example, but in the first reaction process changing the reaction conditions and the monomer and number of mass parts for the polyhydric alcohol component and/or the polybasic carboxylic acid component as shown in Table 1-1, and in the second reaction process changing the reaction conditions and monomer and number of mass parts as shown in Table 1-1. The properties of amorphous polyester resins A2 to A29 are shown in Table 1-2.

TABLE 1-1

| | first reaction process | | | | | | | | | | second reaction process | | | | | |
|---|---|---|---|---|---|---|---|---|---|---|---|---|---|---|---|---|
| | polyhydric alcohol component | | | | polybasic carboxylic acid component | | | | reaction conditions | | crosslinking component | | | | reaction conditions | |
| amorphous | monomer | | | | monomer | | | | tem- | | monomer | | | | tem- | |
| polyester resin | monomer | parts | moles | mol % | monomer | parts | moles | mol % | perature [° C.] | time [h] | monomer | parts | moles | mol % | perature [° C.] | time [h] |
| A1 | BPA | 71.5 | 0.18 | 100.0 | TPA | 12.6 | 0.08 | 50.0 | 200 | 4.0 | TMA | 16.0 | 0.05 | 50.0 | 180 | 1.0 |
| A2 | BPA | 72.7 | 0.18 | 100.0 | TPA | 19.2 | 0.12 | 75.0 | 200 | 4.0 | TMA | 8.1 | 0.04 | 25.0 | 180 | 1.0 |
| A3 | BPA | 70.3 | 0.18 | 100.0 | TPA | 4.9 | 0.03 | 20.0 | 200 | 4.0 | TMA | 25.1 | 0.12 | 80.0 | 180 | 1.0 |
| A4 | BPA | 72.7 | 0.18 | 100.0 | TPA | 19.5 | 0.12 | 76.0 | 200 | 4.0 | TMA | 7.8 | 0.04 | 24.0 | 180 | 1.0 |
| A5 | BPA | 70.0 | 0.18 | 100.0 | TPA | 4.7 | 0.03 | 19.0 | 200 | 4.0 | TMA | 25.3 | 0.12 | 81.0 | 180 | 1.0 |
| A6 | BPA | 72.7 | 0.18 | 100.0 | TPA | 19.5 | 0.12 | 76.0 | 200 | 2.0 | TMA | 7.8 | 0.04 | 24.0 | 180 | 0.5 |
| A7 | BPA | 72.7 | 0.18 | 100.0 | TPA | 19.5 | 0.12 | 76.0 | 200 | 4.0 | TMA | 7.8 | 0.04 | 24.0 | 180 | 3.0 |
| A8 | BPA | 72.7 | 0.18 | 100.0 | TPA | 19.5 | 0.12 | 76.0 | 200 | 1.0 | TMA | 7.8 | 0.04 | 24.0 | 180 | 0.5 |
| A9 | BPA | 72.7 | 0.18 | 100.0 | TPA | 19.5 | 0.12 | 76.0 | 200 | 4.0 | TMA | 7.8 | 0.04 | 24.0 | 180 | 4.0 |
| A10 | BPA | 72.9 | 0.19 | 100.0 | TPA | 20.5 | 0.12 | 80.0 | 200 | 2.0 | TMA | 6.5 | 0.03 | 20.0 | 180 | 1.0 |
| A11 | BPA | 72.9 | 0.19 | 100.0 | TPA | 20.5 | 0.12 | 80.0 | 200 | 5.0 | TMA | 6.5 | 0.03 | 20.0 | 180 | 4.0 |
| A12 | BPA | 73.2 | 0.19 | 100.0 | TPA | 21.9 | 0.13 | 85.0 | 200 | 2.0 | TMA | 4.9 | 0.02 | 15.0 | 180 | 1.5 |
| A13 | BPA | 73.2 | 0.19 | 100.0 | TPA | 21.9 | 0.13 | 85.0 | 200 | 5.0 | TMA | 4.9 | 0.02 | 15.0 | 180 | 5.0 |
| A14 | BPA | 72.7 | 0.18 | 100.0 | TPA | 19.5 | 0.12 | 76.0 | 200 | 0.5 | TMA | 7.8 | 0.04 | 24.0 | 180 | 0.5 |
| A15 | BPA | 72.7 | 0.18 | 100.0 | TPA | 19.5 | 0.12 | 76.0 | 200 | 6.0 | TMA | 7.8 | 0.04 | 24.0 | 180 | 5.0 |
| A16 | BPA | 73.2 | 0.19 | 100.0 | TPA | 21.9 | 0.13 | 85.0 | 200 | 0.5 | TMA | 4.9 | 0.02 | 15.0 | 180 | 0.5 |
| A17 | BPA | 73.2 | 0.19 | 100.0 | TPA | 21.9 | 0.13 | 85.0 | 200 | 6.0 | TMA | 4.9 | 0.02 | 15.0 | 180 | 5.0 |
| A18 | BPA | 73.2 | 0.19 | 100.0 | TPA | 21.9 | 0.13 | 85.0 | 180 | 0.5 | TMA | 4.9 | 0.02 | 15.0 | 150 | 0.5 |
| A19 | BPA | 73.2 | 0.19 | 100.0 | TPA | 21.9 | 0.13 | 85.0 | 200 | 6.0 | TMA | 4.9 | 0.02 | 15.0 | 200 | 6.0 |
| A20 | BPA | 73.2 | 0.19 | 100.0 | TPA | 21.9 | 0.13 | 85.0 | 150 | 0.5 | TMA | 4.9 | 0.02 | 15.0 | 150 | 0.5 |

TABLE 1-1-continued

| amorphous polyester resin | first reaction process: polyhydric alcohol component monomer monomer | parts | moles | mol % | polybasic carboxylic acid component monomer | parts | moles | mol % | reaction conditions temperature [° C.] | time [h] | second reaction process: crosslinking component monomer monomer | parts | moles | mol % | reaction conditions temperature [° C.] | time [h] |
|---|---|---|---|---|---|---|---|---|---|---|---|---|---|---|---|---|
| A21 | BPA | 73.2 | 0.19 | 100.0 | TPA | 21.9 | 0.13 | 85.0 | 200 | 8.0 | TMA | 4.9 | 0.02 | 15.0 | 200 | 8.0 |
| A22 | BPA | 73.5 | 0.19 | 100.0 | TPA | 23.3 | 0.14 | 90.0 | 200 | 0.5 | TMA | 3.3 | 0.02 | 10.0 | 180 | 0.5 |
| A23 | BPA | 73.5 | 0.19 | 100.0 | TPA | 23.3 | 0.14 | 90.0 | 200 | 9.0 | TMA | 3.3 | 0.02 | 10.0 | 200 | 9.0 |
| A24 | BPA | 73.2 | 0.19 | 100.0 | TPA | 21.9 | 0.13 | 85.0 | 150 | 0.3 | TMA | 4.9 | 0.02 | 15.0 | 150 | 0.3 |
| A25 | BPA | 73.2 | 0.19 | 100.0 | TPA | 21.9 | 0.13 | 85.0 | 200 | 9.0 | TMA | 4.9 | 0.02 | 15.0 | 200 | 9.0 |
| A26 | BPA | 73.5 | 0.19 | 100.0 | TPA | 23.3 | 0.14 | 90.0 | 150 | 0.3 | TMA | 3.3 | 0.02 | 10.0 | 150 | 0.3 |
| A27 | BPA | 73.5 | 0.19 | 100.0 | TPA | 23.3 | 0.14 | 90.0 | 200 | 9.0 | TMA | 3.3 | 0.02 | 10.0 | 200 | 9.0 |
| A28 | BPA | 74.0 | 0.19 | 100.0 | TPA | 26.0 | 0.16 | 100.0 | 150 | 0.5 | — | — | — | — | — | — |
| A29 | BPA | 73.5 | 0.19 | 100.0 | TPA | 23.3 | 0.14 | 90.0 | 150 | 0.3 | TMA | 3.3 | 0.02 | 10.0 | 150 | 0.1 |

In Table 1, BPA refers to polyoxypropylene(2.2)-2,2-bis(4-hydroxyphenyl)propane; TPA refers to terephthalic acid; and TMA refers to trimellitic anhydride.

TABLE 1-2

| amorphous polyester resin | properties: Mp | Tg [° C.] | Tm [° C.] | $\eta_{0.01(A)}$ [Pa] | $\eta_{0.69(A)}$ [Pa] | $\eta_{0.69(A)}/\eta_{0.01(A)}$ |
|---|---|---|---|---|---|---|
| A1 | 5000 | 54 | 90 | $4.2 \times 10^5$ | $1.8 \times 10^6$ | 4.3 |
| A2 | 5000 | 54 | 90 | $4.2 \times 10^5$ | $1.7 \times 10^6$ | 4.0 |
| A3 | 5000 | 54 | 90 | $4.2 \times 10^5$ | $1.7 \times 10^6$ | 4.0 |
| A4 | 5000 | 54 | 90 | $4.2 \times 10^5$ | $1.5 \times 10^6$ | 3.6 |
| A5 | 5000 | 54 | 90 | $4.2 \times 10^5$ | $1.5 \times 10^6$ | 3.6 |
| A6 | 4500 | 52 | 87 | $2.8 \times 10^5$ | $1.0 \times 10^6$ | 3.6 |
| A7 | 5500 | 54 | 95 | $5.5 \times 10^5$ | $2.0 \times 10^6$ | 3.6 |
| A8 | 4300 | 51 | 85 | $2.5 \times 10^5$ | $9.0 \times 10^5$ | 3.6 |
| A9 | 5700 | 55 | 97 | $5.8 \times 10^5$ | $2.1 \times 10^6$ | 3.6 |
| A10 | 4700 | 53 | 88 | $3.0 \times 10^5$ | $9.0 \times 10^5$ | 3.0 |
| A11 | 5900 | 56 | 98 | $7.0 \times 10^5$ | $2.1 \times 10^6$ | 3.0 |
| A12 | 4800 | 53 | 89 | $3.1 \times 10^5$ | $9.0 \times 10^5$ | 2.9 |
| A13 | 6000 | 56 | 99 | $7.3 \times 10^5$ | $2.1 \times 10^6$ | 2.9 |
| A14 | 4200 | 50 | 84 | $2.4 \times 10^5$ | $8.6 \times 10^5$ | 3.6 |
| A15 | 6100 | 57 | 99 | $7.6 \times 10^5$ | $2.7 \times 10^6$ | 3.6 |
| A16 | 4200 | 50 | 84 | $2.4 \times 10^5$ | $7.0 \times 10^5$ | 2.9 |
| A17 | 6100 | 57 | 99 | $7.6 \times 10^5$ | $2.2 \times 10^6$ | 2.9 |
| A18 | 4100 | 49 | 83 | $2.0 \times 10^5$ | $5.8 \times 10^5$ | 2.9 |
| A19 | 6300 | 58 | 99 | $8.0 \times 10^5$ | $2.3 \times 10^6$ | 2.9 |
| A20 | 4000 | 48 | 82 | $2.0 \times 10^5$ | $5.8 \times 10^5$ | 2.9 |
| A21 | 6500 | 59 | 100 | $8.2 \times 10^5$ | $2.4 \times 10^6$ | 2.9 |
| A22 | 4100 | 49 | 84 | $2.3 \times 10^5$ | $5.8 \times 10^5$ | 2.5 |
| A23 | 6600 | 59 | 101 | $9.5 \times 10^5$ | $2.4 \times 10^6$ | 2.5 |
| A24 | 3900 | 47 | 81 | $1.5 \times 10^5$ | $4.4 \times 10^5$ | 2.9 |
| A25 | 6600 | 60 | 100 | $9.7 \times 10^5$ | $2.9 \times 10^5$ | 2.9 |
| A26 | 3900 | 47 | 81 | $1.5 \times 10^5$ | $3.7 \times 10^5$ | 2.5 |
| A27 | 6600 | 60 | 100 | $9.7 \times 10^5$ | $2.5 \times 10^6$ | 2.5 |
| A28 | 3900 | 47 | 81 | $1.5 \times 10^5$ | $3.1 \times 10^6$ | 2.1 |
| A29 | 3700 | 45 | 79 | $1.3 \times 10^5$ | $3.1 \times 10^6$ | 2.5 |

Amorphous Polyester Resin B1 Production Example

| | |
|---|---|
| polyoxypropylene(2.2)-2,2-bis(4-hydroxyphenyl)propane (0.19 moles, 100.0 mol % with reference to the total number of moles of polyhydric alcohol) | 73.8 parts |
| terephthalic acid (0.08 moles, 48.0 mol % with reference to the total number of moles of polybasic carboxylic acid) | 12.5 parts |

-continued

| | |
|---|---|
| adipic acid (0.05 moles, 34.0 mol % with reference to the total number of moles of polybasic carboxylic acid) | 7.8 parts |
| titanium tetrabutoxide (esterification catalyst) | 0.5 parts |

These substances were weighed into a reaction vessel fitted with a condenser, stirrer, nitrogen introduction line, and thermocouple.

The interior of the reaction vessel was subsequently substituted with nitrogen gas; the temperature was then gradually raised while stirring; and a reaction was run for 2 hours while stirring at a temperature of 200° C.

The pressure within the reaction vessel was dropped to 8.3 kPa; holding was carried out for 1 hour; and then cooling to 160° C. and return to atmospheric pressure were performed (first reaction process).

| | |
|---|---|
| trimellitic anhydride (0.03 moles, 18.0 mol % with reference to the total number of moles of polybasic carboxylic acid) | 5.9 parts |
| tert-butylcatechol (polymerization inhibitor) | 0.1 parts |

These substances were then added and the pressure within the reaction vessel was dropped to 8.3 kPa and the temperature was held at 200° C. and a reaction was carried out for 15 hours in this condition. After confirming that the softening point, as measured in accordance with ASTM D 36-86, had reached 140° C., the temperature was lowered and the reaction was stopped (second reaction process), thereby yielding resin B1.

The resulting amorphous polyester resin B1 had a peak molecular weight (Mp) of 10,000, a softening point (Tm) of 140° C., and a glass transition temperature (Tg) of 60° C.

Crystalline Polyester Resin C1 Production Example

| | |
|---|---|
| hexanediol (0.29 moles, 100.0 mol % with reference to the total number of moles of polyhydric alcohol) | 34.5 parts |
| dodecanedioic acid | 65.5 parts |

(0.28 moles, 100.0 mol % with reference to the total number of moles of polybasic carboxylic acid)

These substances were weighed into a reaction vessel fitted with a condenser, stirrer, nitrogen introduction line, and thermocouple.

The interior of the reaction vessel was subsequently substituted with nitrogen gas; the temperature was then gradually raised while stirring; and a reaction was run for 3 hours while stirring at a temperature of 140° C.

| | |
|---|---|
| tin 2-ethylhexanoate | 0.5 parts |

This substance was then added and the pressure within the reaction vessel was dropped to 8.3 kPa and the temperature was held at 200° C. and a reaction was carried out for 4 hours in this condition to obtain a crystalline polyester resin C1 (first reaction process).

The resulting crystalline polyester resin C1 had a peak molecular weight (Mp) of 10,000 and a melting point of 71° C.

Production Example for Polymer D1 of Styrene-Acrylic Polymer Graft Polymerized on Polyolefin

| | |
|---|---|
| low molecular weight polypropylene (Sanyo Chemical Industries, Ltd., VISCOL 660P) (0.02 moles, 3.0 mol % with reference to the total number of moles of monomer for producing the polymer) | 11.9 parts |
| xylene | 25.0 parts |

These substances were weighed into a reaction vessel fitted with a condenser, stirrer, nitrogen introduction line, and thermocouple.

The interior of the reaction vessel was subsequently substituted with nitrogen gas and the temperature was then gradually raised to 175° C. while stirring.

| | |
|---|---|
| styrene (0.65 moles, 78.4 mol % with reference to the total number of moles of monomer for producing the polymer) | 67.3 parts |
| cyclohexyl methacrylate (0.04 moles, 4.9 mol % with reference to the total number of moles of monomer for producing the polymer) | 6.3 parts |
| butyl acrylate (0.11 moles, 13.7 mol % with reference to the total number of moles of monomer for producing the polymer) | 14.5 parts |
| xylene | 10.0 parts |
| di-t-butyl peroxyhexahydroterephthalate | 0.5 parts |

These substances were then added dropwise over 3 hours and stirring was carried out for an additional 30 minutes. The solvent was subsequently distilled off to obtain a polymer D1. The obtained polymer D1 had a peak molecular weight (Mp) of 6,000 and a softening point (Tm) of 125° C.

Toner 1 Production Example

| | |
|---|---|
| amorphous polyester resin A1 | 60.0 parts |
| amorphous polyester resin B1 | 30.0 parts |
| crystalline polyester resin C1 | 10.0 parts |
| polymer D1 | 4.0 parts |
| release agent E1 (Fischer-Tropsch wax) (peak temperature of maximum endothermic peak = 90° C.) | 4.0 parts |
| C.I. Pigment Blue 15:3 | 7.0 parts |

These substances were mixed using a Henschel mixer (Model FM-75, Mitsui Mining Co., Ltd.) at a rotation rate of 20 $s^{-1}$ for a rotation time of 5 minutes; this was followed by melt-kneading with a twin-screw extruder (Model PCM-30, Ikegai Corp) set to a temperature of 130° C.

The resulting kneaded material was cooled and coarsely pulverized to 1 mm and below using a hammer mill to obtain a coarsely pulverized material.

The obtained coarsely pulverized material was finely pulverized using a mechanical pulverizer (T-250, Turbo Kogyo Co., Ltd.).

Classification was also carried out using a Faculty F-300 (Hosokawa Micron Corporation) to obtain resin particles.

The operating conditions were a classification rotor rotation rate of 130 $s^{-1}$ and a dispersion rotor rotation rate of 120 $s^{-1}$.

The resulting resin particles were heated treated using the heat-treatment apparatus shown in FIG. 1 to obtain toner particles.

The operating conditions were as follows: feed rate=5 kg/hr; hot air current temperature=160° C.; hot air current flow rate=6 $m^3$/min; cold air current temperature=−5° C.; cold air current flow rate=4 $m^3$/min; blower output=20 $m^3$/min; and injection air flow rate=1 $m^3$/min.

A Toner 1 was obtained by mixing the following—using a Henschel mixer (Model FM-75, Mitsui Miike Chemical Engineering Machinery Co., Ltd.) at a rotation rate of 30 $s^{-1}$ and a rotation time of 10 minutes—with 100 mass parts of the toner particles: 1.0 parts of hydrophobic silica fine particles (BET: 200 $m^2$/g) that had been surface-treated with hexamethyldisilazane and 1.0 parts of titanium oxide fine particles (BET: 80 $m^2$/g) that had been surface-treated with isobutyltrimethoxysilane.

Toner 1 had a weight-average particle diameter (D4) of 6.5 μm and an average circularity of 0.968. The properties of Toner 1 are given in Table 2-1 and Table 2-2.

Toners 2 to 39 Production Example

Toner 2 to Toner 39 were obtained by carrying out the same process as in the Toner 1 Production Example, but omitting the step with the heat-treatment apparatus and changing the amorphous polyester resin A1, amorphous polyester resin B1, crystalline polyester resin C1, polymer D1, and release agent to that in Table 2-1. The properties of Toner 2 to Toner 39 are given in Table 2-1 and Table 2-2.

TABLE 2-1

| | formulation | | | | | | | | | | | production method heat- | amorphous resin composition: polyhydric alcohol component | | polybasic carboxylic acid component | | | | | |
|---|---|---|---|---|---|---|---|---|---|---|---|---|---|---|---|---|---|---|---|---|
| toner No. | resin | parts | resin | parts | resin | parts | additive | parts | release agent | parts | | treatment apparatus | monomer | mol % | monomer | mol % | monomer | mol % | monomer | mol % |
| 1 | A1 | 60.0 | B1 | 30.0 | C1 | 10.0 | D1 | 4.0 | E1 | 4.0 | | yes | BPA | 100.0 | TPA | 49.3 | AA | 11.6 | TMA | 39.1 |
| 2 | A1 | 60.0 | B1 | 30.0 | C1 | 10.0 | D1 | 4.0 | E1 | 4.0 | | no | BPA | 100.0 | TPA | 49.3 | AA | 11.6 | TMA | 39.1 |
| 3 | A1 | 60.0 | B1 | 30.0 | C1 | 10.0 | — | — | E1 | 4.0 | | no | BPA | 100.0 | TPA | 49.3 | AA | 11.6 | TMA | 39.1 |

TABLE 2-1-continued

| | formulation | | | | | | | | | | production method heat- | amorphous resin composition: polyhydric alcohol component | | polybasic carboxylic acid component | | | | | |
|---|---|---|---|---|---|---|---|---|---|---|---|---|---|---|---|---|---|---|---|
| toner No. | resin | parts | resin | parts | resin | parts | additive | parts | release agent | parts | treatment apparatus | monomer | mol % | monomer | mol % | monomer | mol % | monomer | mol % |
| 4 | A2 | 60.0 | B1 | 30.0 | C1 | 10.0 | — | — | E1 | 4.0 | no | BPA | 100.0 | TPA | 65.9 | AA | 11.5 | TMA | 22.6 |
| 5 | A3 | 60.0 | B1 | 30.0 | C1 | 10.0 | — | — | E1 | 4.0 | no | BPA | 100.0 | TPA | 29.7 | AA | 11.7 | TMA | 58.6 |
| 6 | A4 | 60.0 | B1 | 30.0 | C1 | 10.0 | — | — | E1 | 4.0 | no | BPA | 100.0 | TPA | 66.6 | AA | 11.4 | TMA | 22.0 |
| 7 | A5 | 60.0 | B1 | 30.0 | C1 | 10.0 | — | — | E1 | 4.0 | no | BPA | 100.0 | TPA | 29.0 | AA | 11.7 | TMA | 59.2 |
| 8 | A4 | 60.0 | B1 | 30.0 | C1 | 10.0 | — | — | E1 | 3.5 | no | BPA | 100.0 | TPA | 66.6 | AA | 11.4 | TMA | 22.0 |
| 9 | A4 | 60.0 | B1 | 30.0 | C1 | 10.0 | — | — | E1 | 6.0 | no | BPA | 100.0 | TPA | 66.6 | AA | 11.4 | TMA | 22.0 |
| 10 | A4 | 60.0 | B1 | 30.0 | C1 | 10.0 | — | — | E1 | 3.0 | no | BPA | 100.0 | TPA | 66.6 | AA | 11.4 | TMA | 22.0 |
| 11 | A4 | 60.0 | B1 | 30.0 | C1 | 10.0 | — | — | E1 | 6.5 | no | BPA | 100.0 | TPA | 66.6 | AA | 11.4 | TMA | 22.0 |
| 12 | A4 | 45.0 | B1 | 45.0 | C1 | 10.0 | — | — | E1 | 3.0 | no | BPA | 100.0 | TPA | 61.9 | AA | 17.1 | TMA | 21.0 |
| 13 | A4 | 75.0 | B1 | 15.0 | C1 | 10.0 | — | — | E1 | 3.0 | no | BPA | 100.0 | TPA | 69.7 | AA | 7.6 | TMA | 22.7 |
| 14 | A4 | 40.0 | B1 | 50.0 | C1 | 10.0 | — | — | E1 | 3.0 | no | BPA | 100.0 | TPA | 60.3 | AA | 19.0 | TMA | 20.6 |
| 15 | A4 | 90.0 | B1 | 10.0 | C1 | 10.0 | — | — | E1 | 3.0 | no | BPA | 100.0 | TPA | 71.3 | AA | 5.7 | TMA | 23.0 |
| 16 | A6 | 40.0 | B1 | 50.0 | C1 | 10.0 | — | — | E1 | 3.0 | no | BPA | 100.0 | TPA | 60.3 | AA | 19.0 | TMA | 20.6 |
| 17 | A7 | 40.0 | B1 | 50.0 | C1 | 10.0 | — | — | E1 | 3.0 | no | BPA | 100.0 | TPA | 60.3 | AA | 19.0 | TMA | 20.6 |
| 18 | A8 | 40.0 | B1 | 50.0 | C1 | 10.0 | — | — | E1 | 3.0 | no | BPA | 100.0 | TPA | 60.3 | AA | 19.0 | TMA | 20.6 |
| 19 | A9 | 40.0 | B1 | 50.0 | C1 | 10.0 | — | — | E1 | 3.0 | no | BPA | 100.0 | TPA | 60.3 | AA | 19.0 | TMA | 20.6 |
| 20 | A10 | 40.0 | B1 | 50.0 | C1 | 10.0 | — | — | E1 | 3.0 | no | BPA | 100.0 | TPA | 62.1 | AA | 19.0 | TMA | 18.9 |
| 21 | A11 | 40.0 | B1 | 50.0 | C1 | 10.0 | — | — | E1 | 3.0 | no | BPA | 100.0 | TPA | 62.1 | AA | 19.0 | TMA | 18.9 |
| 22 | A12 | 40.0 | B1 | 50.0 | C1 | 10.0 | — | — | E1 | 3.0 | no | BPA | 100.0 | TPA | 64.4 | AA | 19.0 | TMA | 16.7 |
| 23 | A13 | 40.0 | B1 | 50.0 | C1 | 10.0 | — | — | E1 | 3.0 | no | BPA | 100.0 | TPA | 64.4 | AA | 19.0 | TMA | 16.7 |
| 24 | A14 | 40.0 | B1 | 50.0 | C1 | 10.0 | — | — | E1 | 3.0 | no | BPA | 100.0 | TPA | 60.3 | AA | 19.0 | TMA | 20.6 |
| 25 | A15 | 40.0 | B1 | 50.0 | C1 | 10.0 | — | — | E1 | 3.0 | no | BPA | 100.0 | TPA | 60.3 | AA | 19.0 | TMA | 20.6 |
| 26 | A16 | 40.0 | B1 | 50.0 | C1 | 10.0 | — | — | E1 | 3.0 | no | BPA | 100.0 | TPA | 64.4 | AA | 19.0 | TMA | 16.7 |
| 27 | A17 | 40.0 | B1 | 50.0 | C1 | 10.0 | — | — | E1 | 3.0 | no | BPA | 100.0 | TPA | 64.4 | AA | 19.0 | TMA | 16.7 |
| 28 | A18 | 40.0 | B1 | 50.0 | C1 | 10.0 | — | — | E1 | 3.0 | no | BPA | 100.0 | TPA | 64.4 | AA | 19.0 | TMA | 16.7 |
| 29 | A19 | 40.0 | B1 | 50.0 | C1 | 10.0 | — | — | E1 | 3.0 | no | BPA | 100.0 | TPA | 64.4 | AA | 19.0 | TMA | 16.7 |
| 30 | A20 | 40.0 | B1 | 50.0 | C1 | 10.0 | — | — | E1 | 3.0 | no | BPA | 100.0 | TPA | 64.4 | AA | 19.0 | TMA | 16.7 |
| 31 | A21 | 40.0 | B1 | 50.0 | C1 | 10.0 | — | — | E1 | 3.0 | no | BPA | 100.0 | TPA | 64.4 | AA | 19.0 | TMA | 16.7 |
| 32 | A22 | 40.0 | B1 | 50.0 | C1 | 10.0 | — | — | E1 | 3.0 | no | BPA | 100.0 | TPA | 66.6 | AA | 18.9 | TMA | 14.5 |
| 33 | A23 | 40.0 | B1 | 50.0 | C1 | 10.0 | — | — | E1 | 3.0 | no | BPA | 100.0 | TPA | 66.6 | AA | 18.9 | TMA | 14.5 |
| 34 | A24 | 40.0 | B1 | 50.0 | C1 | 10.0 | — | — | E1 | 3.0 | no | BPA | 100.0 | TPA | 64.4 | AA | 19.0 | TMA | 16.7 |
| 35 | A25 | 40.0 | B1 | 50.0 | C1 | 10.0 | — | — | E1 | 3.0 | no | BPA | 100.0 | TPA | 64.4 | AA | 19.0 | TMA | 16.7 |
| 36 | A26 | 40.0 | B1 | 50.0 | C1 | 10.0 | — | — | E1 | 3.0 | no | BPA | 100.0 | TPA | 66.6 | AA | 18.9 | TMA | 14.5 |
| 37 | A27 | 40.0 | B1 | 50.0 | C1 | 10.0 | — | — | E1 | 3.0 | no | BPA | 100.0 | TPA | 66.6 | AA | 18.9 | TMA | 14.5 |
| 38 | A28 | 40.0 | B1 | 50.0 | C1 | 10.0 | — | — | E1 | 3.0 | no | BPA | 100.0 | TPA | 71.1 | AA | 18.9 | TMA | 10.0 |
| 39 | A29 | 40.0 | B1 | 50.0 | C1 | 10.0 | — | — | E1 | 3.0 | no | BPA | 100.0 | TPA | 66.6 | AA | 18.9 | TMA | 14.5 |

In Table 2, BPA refers to polyoxypropylene(2.2)-2,2-bis(4-hydroxyphenyl)propane; TPA refers to terephthalic acid; AA refers to adipic acid; and TMA refers to trimellitic anhydride.

TABLE 2-2

| | content: amorphous | | properties | | | | | | |
|---|---|---|---|---|---|---|---|---|---|
| toner No. | polyester resin A [mass %] | release agent [mass %] | D4 [μm] | average circularity | Tm [° C.] | Tg [° C.] | $\eta_{0.01}$ [Pa] | $\eta_{0.69}$) [Pa] | $\eta_{0.69}/\eta_{0.01}$ |
| 1 | 52.2 | 3.5 | 6.5 | 0.968 | 95 | 37 | $7.2 \times 10^4$ | $1.9 \times 10^5$ | 2.6 |
| 2 | 52.2 | 3.5 | 6.5 | 0.955 | 97 | 38 | $7.2 \times 10^4$ | $1.9 \times 10^5$ | 2.6 |
| 3 | 54.1 | 3.6 | 6.5 | 0.955 | 98 | 39 | $7.2 \times 10^4$ | $1.9 \times 10^5$ | 2.6 |
| 4 | 54.1 | 3.6 | 6.4 | 0.955 | 98 | 39 | $7.2 \times 10^4$ | $1.9 \times 10^5$ | 2.6 |
| 5 | 54.1 | 3.6 | 6.4 | 0.955 | 98 | 39 | $7.2 \times 10^4$ | $1.9 \times 10^5$ | 2.6 |
| 6 | 54.1 | 3.6 | 6.4 | 0.955 | 98 | 39 | $7.2 \times 10^4$ | $1.9 \times 10^5$ | 2.6 |
| 7 | 54.1 | 3.6 | 6.5 | 0.956 | 98 | 39 | $7.2 \times 10^4$ | $1.9 \times 10^5$ | 2.6 |
| 8 | 54.3 | 3.2 | 6.5 | 0.956 | 98 | 39 | $7.2 \times 10^4$ | $1.9 \times 10^5$ | 2.6 |
| 9 | 53.1 | 5.3 | 6.6 | 0.956 | 98 | 39 | $7.2 \times 10^4$ | $1.9 \times 10^5$ | 2.6 |
| 10 | 54.5 | 2.7 | 6.5 | 0.956 | 98 | 39 | $7.2 \times 10^4$ | $1.9 \times 10^5$ | 2.6 |
| 11 | 52.9 | 5.7 | 6.4 | 0.956 | 98 | 39 | $7.2 \times 10^4$ | $1.9 \times 10^5$ | 2.6 |
| 12 | 40.9 | 2.7 | 6.5 | 0.955 | 102 | 41 | $8.5 \times 10^4$ | $2.2 \times 10^5$ | 2.6 |
| 13 | 68.2 | 2.7 | 6.5 | 0.955 | 95 | 36 | $5.8 \times 10^4$ | $1.5 \times 10^5$ | 2.6 |
| 14 | 36.4 | 2.7 | 6.5 | 0.955 | 103 | 42 | $8.4 \times 10^4$ | $2.2 \times 10^5$ | 2.6 |
| 15 | 75.0 | 2.7 | 6.6 | 0.955 | 94 | 35 | $5.7 \times 10^4$ | $1.5 \times 10^5$ | 2.6 |
| 16 | 36.4 | 2.7 | 6.6 | 0.955 | 101 | 40 | $5.6 \times 10^4$ | $1.5 \times 10^5$ | 2.6 |

TABLE 2-2-continued

| | content | | properties | | | | | | |
|---|---|---|---|---|---|---|---|---|---|
| | amorphous | | | | | | | | |
| toner No. | polyester resin A [mass %] | release agent [mass %] | D4 [μm] | average circularity | Tm [° C.] | Tg [° C.] | $\eta_{0.01}$ [Pa] | $\eta_{0.69}$ [Pa] | $\eta_{0.69}/\eta_{0.01}$ |
| 17 | 36.4 | 2.7 | 6.6 | 0.955 | 105 | 44 | $1.1 \times 10^5$ | $2.9 \times 10^5$ | 2.6 |
| 18 | 36.4 | 2.7 | 6.6 | 0.955 | 100 | 39 | $5.0 \times 10^4$ | $1.3 \times 10^5$ | 2.6 |
| 19 | 36.4 | 2.7 | 6.6 | 0.955 | 106 | 45 | $1.2 \times 10^5$ | $3.0 \times 10^5$ | 2.6 |
| 20 | 36.4 | 2.7 | 6.5 | 0.955 | 102 | 41 | $6.0 \times 10^4$ | $1.5 \times 10^5$ | 2.5 |
| 21 | 36.4 | 2.7 | 6.5 | 0.955 | 107 | 46 | $1.4 \times 10^5$ | $3.5 \times 10^5$ | 2.5 |
| 22 | 36.4 | 2.7 | 6.6 | 0.954 | 102 | 42 | $6.2 \times 10^4$ | $1.6 \times 10^5$ | 2.5 |
| 23 | 36.4 | 2.7 | 6.6 | 0.954 | 108 | 47 | $1.5 \times 10^5$ | $3.7 \times 10^5$ | 2.5 |
| 24 | 36.4 | 2.7 | 6.6 | 0.955 | 99 | 39 | $4.8 \times 10^4$ | $1.3 \times 10^5$ | 2.6 |
| 25 | 36.4 | 2.7 | 6.6 | 0.955 | 109 | 47 | $1.5 \times 10^5$ | $4.0 \times 10^5$ | 2.6 |
| 26 | 36.4 | 2.7 | 6.6 | 0.954 | 99 | 39 | $4.8 \times 10^4$ | $1.2 \times 10^5$ | 2.5 |
| 27 | 36.4 | 2.7 | 6.6 | 0.954 | 109 | 47 | $1.5 \times 10^5$ | $3.8 \times 10^5$ | 2.5 |
| 28 | 36.4 | 2.7 | 6.6 | 0.954 | 98 | 38 | $4.0 \times 10^4$ | $1.0 \times 10^5$ | 2.5 |
| 29 | 36.4 | 2.7 | 6.6 | 0.954 | 110 | 48 | $1.6 \times 10^5$ | $4.0 \times 10^5$ | 2.5 |
| 30 | 36.4 | 2.7 | 6.6 | 0.954 | 97 | 37 | $4.0 \times 10^4$ | $9.9 \times 10^4$ | 2.5 |
| 31 | 36.4 | 2.7 | 6.6 | 0.954 | 111 | 49 | $1.6 \times 10^5$ | $4.1 \times 10^5$ | 2.5 |
| 32 | 36.4 | 2.7 | 6.5 | 0.955 | 98 | 39 | $4.7 \times 10^4$ | $9.9 \times 10^4$ | 2.1 |
| 33 | 36.4 | 2.7 | 6.5 | 0.955 | 112 | 49 | $1.9 \times 10^5$ | $4.1 \times 10^5$ | 2.1 |
| 34 | 36.4 | 2.7 | 6.6 | 0.954 | 96 | 36 | $3.0 \times 10^4$ | $7.5 \times 10^4$ | 2.5 |
| 35 | 36.4 | 2.7 | 6.6 | 0.954 | 112 | 50 | $2.0 \times 10^5$ | $5.0 \times 10^5$ | 2.5 |
| 36 | 36.4 | 2.7 | 6.5 | 0.955 | 96 | 36 | $3.0 \times 10^4$ | $6.3 \times 10^4$ | 2.1 |
| 37 | 36.4 | 2.7 | 6.5 | 0.955 | 112 | 50 | $2.0 \times 10^5$ | $4.2 \times 10^5$ | 2.1 |
| 38 | 36.4 | 2.7 | 6.5 | 0.955 | 96 | 36 | $3.0 \times 10^4$ | $5.7 \times 10^4$ | 1.9 |
| 39 | 36.4 | 2.7 | 6.5 | 0.955 | 94 | 34 | $2.7 \times 10^4$ | $5.7 \times 10^4$ | 2.1 |

Magnetic Core Particle 1 Production Example

Step 1 (Weighing·Mixing Step):

| | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 parts |

The ferrite starting materials were weighed out so that these materials assumed the composition ratio given above. This was followed by pulverization and mixing for 5 hours using a dry vibrating mill using stainless steel beads having a diameter of ⅛-inch.

Step 2 (Pre-Firing Step):

The obtained pulverizate was converted into approximately 1 mm-square pellets using a roller compactor. After removal of the coarse powder using a vibrating screen having an aperture of 3 mm and subsequent removal of the fines using a vibrating screen having an aperture of 0.5 mm, the pellets were fired for 4 hours at a temperature of 1,000° C. in a burner-type firing furnace under a nitrogen atmosphere (oxygen concentration: 0.01 volume %) to produce a pre-fired ferrite. The composition of the resulting pre-fired ferrite was as follows:

$$(MnO)_a(MgO)_b(SrO)_c(Fe_2O_3)_d$$

in this formula, a=0.257, b=0.117, c=0.007, d=0.393.

Step 3 (Pulverization Step):

The resulting pre-fired ferrite was pulverized to about 0.3 mm with a crusher followed by pulverization for 1 hour with a wet ball mill using zirconia beads having a diameter of ⅛-inch and with the addition of 30 parts of water per 100 parts of the pre-fired ferrite. The obtained slurry was milled for 4 hours using a wet ball mill using alumina beads with a diameter of 1/16-inch to obtain a ferrite slurry (finely pulverized pre-fired ferrite).

Step 4 (Granulation Step):

1.0 parts of an ammonium polycarboxylate as a dispersing agent and 2.0 parts of polyvinyl alcohol as a binder per 100 parts of the pre-fired ferrite were added to the ferrite slurry, followed by granulation with a spray dryer (manufacturer: Ohkawara Kakohki Co., Ltd.) into spherical particles. Particle size adjustment was carried out on the obtained particles, which were subsequently heated for 2 hours at 650° C. using a rotary kiln to remove the organic components, e.g., the dispersing agent and binder.

Step 5 (Firing Step):

In order to control the firing atmosphere, the temperature was raised over 2 hours from room temperature to a temperature of 1,300° C. in an electric furnace under a nitrogen atmosphere (oxygen concentration: 1.00 volume %); firing was then carried out for 4 hours at a temperature of 1,150° C. This was followed by cooling to a temperature of 60° C. over 4 hours; returning to the atmosphere from the nitrogen atmosphere; and removal at a temperature at or below 40° C.

Step 6 (Classification Step):

After the aggregated particles had been crushed, the weakly magnetic fraction was cut out by magnetic separation and the coarse particles were removed by sieving on a sieve with an aperture of 250 μm to obtain a magnetic core particle 1 having a 50% particle diameter on a volume basis (D50) of 37.0 μm.

<Preparation of Coating Resin 1>

| | |
|---|---|
| cyclohexyl methacrylate monomer | 26.8 mass % |
| methyl methacrylate monomer | 0.2 mass % |
| methyl methacrylate macromonomer (macromonomer having a weight-average molecular weight of 5,000 and having the methacryloyl group at one terminal) | 8.4 mass % |
| toluene | 31.3 mass % |
| methyl ethyl ketone | 31.3 mass % |
| azobisisobutyronitrile | 2.0 mass % |

Of these materials, the cyclohexyl methacrylate monomer, methyl methacrylate monomer, methyl methacrylate macromonomer, toluene, and methyl ethyl ketone were introduced into a four-neck separable flask fitted with a reflux condenser, thermometer, nitrogen introduction line, and stirring apparatus, and nitrogen gas was introduced to carry out a thorough conversion into a nitrogen atmosphere. This was followed by heating to 80° C. and addition of the azobisisobutyronitrile and polymerization for 5 hours under reflux. The copolymer was precipitated by pouring hexane into the obtained reaction product and the precipitate was separated by filtration and then vacuum dried to obtain a coating resin 1.

30 parts of the coating resin 1 was then dissolved in 40 parts of toluene and 30 parts of methyl ethyl ketone to obtain a polymer solution 1 (30 mass % solids).

<Preparation of Coating Resin Solution 1>

| | |
|---|---|
| polymer solution 1 (30% resin solids concentration) | 33.3 mass % |
| toluene | 66.4 mass % |
| carbon black (Regal 330, Cabot Corporation) (primary particle diameter = 25 nm, specific surface area by nitrogen adsorption = 94 $m^2/g$, DBP absorption = 75 mL/100 g) | 0.3 mass % |

were dispersed for 1 hour using a paint shaker and zirconia beads having a diameter of 0.5 mm. The obtained dispersion was filtered on a 5.0-μm membrane filter to obtain a coating resin solution 1.

Magnetic Carrier 1 Production Example (Resin Coating Step):

The magnetic core particle 1 and the coating resin solution 1 were introduced into a vacuum-degassed kneader being maintained at normal temperature (the amount of introduction for the coating resin solution 1 was an amount that provided 2.5 parts as the resin component per 100 parts of the magnetic core particle 1). After introduction, stirring was performed for 15 minutes at a rotation rate of 30 rpm and, after at least a certain amount (80 mass %) of the solvent had been evaporated, the temperature was raised to 80° C. while mixing under reduced pressure and the toluene was distilled off over 2 hours followed by cooling. The obtained magnetic carrier, after fractionation and separation of the weakly magnetic product by magnetic selection and passage through a screen having an aperture of 70 μm, was classified using an air classifier to obtain a magnetic carrier 1 having a 50% particle diameter on a volume basis (D50) of 38.2 μm.

Two-Component Developer 1 Production Example 8.0 parts of Toner 1 was added to 92.0 parts of magnetic carrier 1 and mixing was performed using a V-mixer (V-20, Seishin Enterprise Co., Ltd.) to obtain a two-component developer 1.

Two-Component Developers 2 to 39 Production Example

Two-component developers 2 to 39 were obtained by carrying out the same procedure as in the Two-Component Developer 1 Production Example, but making the changes shown in Table 3.

TABLE 3

| | two-component developer No. | magnetic carrier No. | toner No. |
|---|---|---|---|
| Example 1 | 1 | 1 | 1 |
| Example 2 | 2 | 1 | 2 |
| Example 3 | 3 | 1 | 3 |
| Example 4 | 4 | 1 | 4 |
| Example 5 | 5 | 1 | 5 |
| Example 6 | 6 | 1 | 6 |
| Example 7 | 7 | 1 | 7 |
| Example 8 | 8 | 1 | 8 |
| Example 9 | 9 | 1 | 9 |
| Example 10 | 10 | 1 | 10 |
| Example 11 | 11 | 1 | 11 |
| Example 12 | 12 | 1 | 12 |
| Example 13 | 13 | 1 | 13 |
| Example 14 | 14 | 1 | 14 |
| Example 15 | 15 | 1 | 15 |
| Example 16 | 16 | 1 | 16 |
| Example 17 | 17 | 1 | 17 |
| Example 18 | 18 | 1 | 18 |
| Example 19 | 19 | 1 | 19 |
| Example 20 | 20 | 1 | 20 |
| Example 21 | 21 | 1 | 21 |
| Example 22 | 22 | 1 | 22 |
| Example 23 | 23 | 1 | 23 |
| Example 24 | 24 | 1 | 24 |
| Example 25 | 25 | 1 | 25 |
| Example 26 | 26 | 1 | 26 |
| Example 27 | 27 | 1 | 27 |
| Example 28 | 28 | 1 | 28 |
| Example 29 | 29 | 1 | 29 |
| Example 30 | 30 | 1 | 30 |
| Example 31 | 31 | 1 | 31 |
| Example 32 | 32 | 1 | 32 |
| Example 33 | 33 | 1 | 33 |
| Example 34 | 34 | 1 | 34 |
| Example 35 | 35 | 1 | 35 |
| Example 36 | 36 | 1 | 36 |
| Example 37 | 37 | 1 | 37 |
| Comparative Example 1 | 38 | 1 | 38 |
| Comparative Example 2 | 39 | 1 | 39 |

Example 1

Evaluations were carried out using the two-component developer 1.

An imageRUNNER ADVANCE C9075 PRO, a printer from Canon, Inc. for digital commercial printing service, was used in a modified form for the image-forming apparatus. The two-component developer 1 was introduced into the developing device at the cyan position, and the evaluations described in the following were carried out by forming images at the desired toner laid-on level on the paper.

The machine was modified to enable the following to be freely settable: the fixation temperature, the process speed, the direct-current voltage $V_{DC}$ for the developer-carrying member, the charging voltage $V_D$ for the electrostatic latent image-bearing member, and the laser power.

FFh images (solid images) were output at the desired image ratio in image output evaluations. Here, FFh is a value where 256 gradations are represented as hexadecimal numbers, wherein 00h is the first gradation (white background area) of the 256 gradations and FFh is the 256th gradation (solid area) of the 256 gradations.

Evaluations were carried out based on the following evaluation methods, and their results are given in Table 4.

[Fixing Release Performance]

paper: GFR-070 (70.0 g/m$^2$)

(sold by Canon Marketing Japan Inc.)

toner laid-on level on the paper: 1.20 mg/cm$^2$ (adjusted using the direct-current voltage $V_{DC}$ for the developer-carrying member, the charging voltage $V_D$ for the electrostatic latent image-bearing member, and the laser power)

evaluation image: a 29 cm×5 cm image was placed leaving a 3 mm leading edge margin in the length direction of the aforementioned A4 paper fixing test environment: high-temperature, high-humidity environment: temperature of 30° C./humidity of 80% RH ("H/H" in the following)

fixation temperature: paper transit at each 1° C. from 120° C. to 170° C.

process speed: 450 mm/sec

The evaluation image was output and the fixing release performance was evaluated. Fixing was carried out at each fixation temperature, and whether wraparound occurred during fixing was visually checked: the maximum temperature at which wraparound was not observed was taken to be the fixing release-limit temperature. The fixing release-limit temperature was evaluated using the following evaluation criteria. A score of C or better was considered excellent in the present invention.

(Evaluation Criteria)

A: the fixing release-limit temperature is 160° C. or above

B: the fixing release-limit temperature is less than 160° C. and is at least 150° C.

C: the fixing release-limit temperature is less than 150° C. and is at least 140° C.

D: the fixing release-limit temperature is less than 140° C. and is at least 130° C.

E: the fixing release-limit temperature is less than 130° C.

[Low-Temperature Fixability]

paper: CS-680 (68.0 g/m$^2$)

(sold by Canon Marketing Japan Inc.)

toner laid-on level on the paper: 1.20 mg/cm$^2$ (adjusted using the direct-current voltage $V_{DC}$ for the developer-carrying member, the charging voltage $V_D$ for the electrostatic latent image-bearing member, and the laser power)

evaluation image: a 2 cm×5 cm image was placed in the center of the aforementioned A4 paper fixing test environment: low-temperature, low-humidity environment: temperature of 15° C./humidity of 10% RH ("L/L" in the following)

fixation temperature: 150° C.

process speed: 450 mm/sec

The evaluation image was output and the low-temperature fixability was evaluated. The value of the percentage decline in the image density was used as the index for evaluation of the low-temperature fixability.

For the percentage reduction in the image density, the image density in the center was first measured; an X-Rite color reflection densitometer (500 Series, X-Rite, Incorporated) is used for the measurement. Then, the fixed image in the area where the image density had been measured is rubbed (5 times back-and-forth) with lens-cleaning paper under a load of 4.9 kPa (50 g/cm$^2$) and the image density is measured again.

The percentage reduction in the image density pre-versus-post-rubbing was calculated using the following formula. The obtained percentage reduction in the image density was evaluated in accordance with the following evaluation criteria. A score of C or better was considered excellent in the present invention.

percentage reduction in image density=(pre-rubbing image density−post-rubbing image density)/pre-rubbing image density×100

(Evaluation Criteria)

A: the percentage reduction in image density is less than 5.0%

B: the percentage reduction in image density is at least 5.0% and is less than 7.5%

C: the percentage reduction in image density is at least 7.5% and is less than 10.0%

D: the percentage reduction in image density is at least 10.0% and is less than 12.5%

E: the percentage reduction in image density is 12.5% or more

[Transfer Efficiency]

paper: CS-680 (68.0 g/m$^2$)

(sold by Canon Marketing Japan Inc.)

toner laid-on level on the paper: 0.35 mg/cm$^2$ (FFh image)

(adjusted using the direct-current voltage $V_{DC}$ for the developer-carrying member, the charging voltage $V_D$ for the electrostatic latent image-bearing member, and the laser power)

evaluation image: 100% image ratio chart for the aforementioned A4 paper fixing test environment: high-temperature, high-humidity environment: temperature of 30° C./humidity of 85% RH ("H/H" in the following)

fixation temperature: 170° C.

process speed: 450 mm/sec

An image output durability test was performed by carrying out the output of 50,000 prints on the A4 paper using a strip chart for FFh output with an image ratio of 0.1%. This was followed by output of the above mentioned evaluation image and visually checking the number of white spots in the image. A score of C or better was considered excellent in the present invention.

(Evaluation Criteria)

A: not more than 1 white spot

B: at least 2 and not more than 3 white spots

C: at least 4 and not more than 5 white spots

D: at least 6 and not more than 7 white spots

E: 8 or more white spots

Examples 2 to 37 and Comparative Examples 1 and 2

The same evaluations as in Example 1 were carried out, but using the two-component developers 2 to 39. The results of the evaluations are given in Table 4.

In contrast to Example 1, the heat-treatment step is not executed in Example 2. As a result, the compatibility of the crystalline resin is somewhat reduced and as a consequence the low-temperature fixability is somewhat reduced compared to Example 1. In addition, the amount of transfer of the release agent to near the vicinity of the toner surface is somewhat reduced and the fixing release performance is then also somewhat inferior to that in Example 1.

The graft polymer is not incorporated in Example 3. As a result, the dispersity of the crystalline resin is somewhat reduced and due to this the low-temperature fixability is somewhat inferior to that in Example 2. In addition, the dispersity of the release agent is somewhat reduced and due to this the fixing release performance is also somewhat inferior to that in Example 2.

In Example 4, the degree of branching due to crosslinking structures is lower and the strain hardening is somewhat reduced and due to this the fixing release performance is somewhat inferior to that in Example 3.

In Example 5, the molecular chain length is shorter and the strain hardening is reduced and due to this the fixing release performance is somewhat inferior to that in Example 3.

In Example 6, the degree of branching due to crosslinking structures is lower and the strain hardening is reduced and due to this the fixing release performance is inferior to that in Example 4.

In Example 7, the molecular chain length is shorter and the strain hardening is reduced and due to this the fixing release performance is inferior to that in Example 5.

In Example 8, the release agent is reduced and the interfacial attachment force then undergoes an increase and due to this the fixing release performance is inferior to that in Example 6.

In Example 9, the transfer efficiency is inferior to that in Example 6 due to an increase in the release agent.

In Example 10, the fixing release performance is inferior to that in Example 8 due to a reduction in the release agent and an increase in the interfacial attachment force.

In Example 11, the transfer efficiency is inferior to that in Example 9 due to an increase in the release agent.

In Example 12, the low-temperature fixability is inferior to that in Example 10 due to a reduced content of the amorphous polyester resin A.

In Example 13, the fixing release performance is inferior to that in Example 10 due to an increased content of the amorphous polyester resin A.

In Example 14, the low-temperature fixability is inferior to that in Example 12 due to a reduced content of the amorphous polyester resin A.

In Example 15, the fixing release performance is inferior to that in Example 13 due to an increased content of the amorphous polyester resin A.

In Example 16, the fixing release performance is inferior to that in Example 14 due to a reduced $\eta_{0.69(A)}$ for the amorphous polyester resin A.

In Example 17, the low-temperature fixability is inferior to that in Example 14 due to an increased $\eta_{0.01(A)}$ for the amorphous polyester resin A.

In Example 18, the fixing release performance is inferior to that in Example 16 due to a reduced $\eta_{0.69(A)}$ for the amorphous polyester resin A.

In Example 19, the low-temperature fixability is inferior to that in Example 17 due to an increased $\eta_{0.01(A)}$ for the amorphous polyester resin A.

In Example 20, the low-temperature fixability is inferior to that in Example 18 due to an increased $\eta_{0.01(A)}$ for the amorphous polyester resin A.

In Example 21, the low-temperature fixability is inferior to that in Example 19 due to an increased $\eta_{0.01(A)}$ for the amorphous polyester resin A.

In Example 22, the low-temperature fixability is inferior to that in Example 20 due to an increased $\eta_{0.01(A)}$ for the amorphous polyester resin A.

In Example 23, the low-temperature fixability is inferior to that in Example 21 due to an increased $\eta_{0.01(A)}$ for the amorphous polyester resin A.

In Example 24, the fixing release performance is inferior to that in Example 18 due to a reduced $\eta_{0.69(A)}$ for the amorphous polyester resin A.

In Example 25, the low-temperature fixability is inferior to that in Example 19 due to an increased $\eta_{0.01(A)}$ for the amorphous polyester resin A.

In Example 26, the fixing release performance is inferior to that in Example 24 due to a reduced $\eta_{0.69(A)}$ for the amorphous polyester resin A.

In Example 27, the fixing release performance is inferior to that in Example 25 due to a reduced $\eta_{0.69(A)}$ for the amorphous polyester resin A.

In Example 28, the fixing release performance is inferior to that in Example 26 due to a reduced $\eta_{0.01}$ for the toner.

In Example 29, the low-temperature fixability is inferior to that in Example 27 due to an increased for the toner.

In Example 30, the fixing release performance is inferior to that in Example 28 due to a reduced $\eta_{0.01}$ for the toner.

In Example 31, the low-temperature fixability is inferior to that in Example 29 due to an increased $\eta_{0.01}$ for the toner.

In Example 32, the low-temperature fixability is inferior to that in Example 30 due to an increased $\eta_{0.01}$ for the toner.

In Example 33, the low-temperature fixability is inferior to that in Example 31 due to an increased $\eta_{0.69}$ for the toner.

In Example 34, the fixing release performance is inferior to that Example 30 due to a reduced $\eta_{0.01}$ for the toner.

In Example 35, the low-temperature fixability is inferior to that in Example 31 due to an increased $\eta_{0.01}$ for the toner.

In Example 36, the fixing release performance is inferior to that in Example 34 due to a reduced $\eta_{0.69}$ for the toner.

In Example 37, the fixing release performance is inferior to that in Example 35 due to an increased $\eta_{0.69}$ for the toner.

In Comparative Example 1, the fixing release performance is much worse than in Example 36 due to a reduced $\eta_{0.69}$ for the toner.

In Comparative Example 2, the fixing release performance is much worse than in Example 36 due to a reduced $\eta_{0.01}$ for the toner.

TABLE 4

| Example No. | transfer efficiency [number] | | | low-temperature fixability | | | fixing release performance [° C.] | |
|---|---|---|---|---|---|---|---|---|
| 1 | A | 0 | A | 1.45⇒1.45 | 0.0 | A | 165 |
| 2 | A | 1 | A | 1.45⇒1.43 | 1.4 | A | 164 |
| 3 | A | 1 | A | 1.45⇒1.41 | 2.8 | A | 163 |
| 4 | A | 1 | A | 1.45⇒1.40 | 3.4 | A | 160 |
| 5 | A | 1 | A | 1.45⇒1.40 | 3.4 | A | 160 |
| 6 | A | 1 | A | 1.45⇒1.40 | 3.4 | B | 157 |
| 7 | A | 1 | A | 1.45⇒1.40 | 3.4 | B | 157 |
| 8 | A | 0 | A | 1.45⇒1.40 | 3.4 | B | 156 |
| 9 | B | 3 | A | 1.45⇒1.39 | 4.1 | B | 158 |
| 10 | A | 0 | A | 1.45⇒1.40 | 3.4 | B | 154 |
| 11 | C | 5 | B | 1.45⇒1.37 | 5.5 | B | 159 |
| 12 | A | 0 | B | 1.45⇒1.37 | 5.5 | B | 156 |
| 13 | A | 0 | A | 1.45⇒1.41 | 2.8 | B | 153 |
| 14 | A | 0 | B | 1.45⇒1.35 | 6.9 | B | 157 |
| 15 | A | 0 | A | 1.45⇒1.42 | 2.1 | B | 152 |
| 16 | A | 0 | A | 1.45⇒1.39 | 4.1 | B | 151 |
| 17 | A | 0 | B | 1.45⇒1.35 | 6.9 | B | 158 |
| 18 | A | 0 | A | 1.45⇒1.40 | 3.4 | C | 149 |
| 19 | A | 0 | C | 1.45⇒1.34 | 7.6 | B | 159 |
| 20 | A | 0 | B | 1.45⇒1.37 | 5.5 | C | 149 |
| 21 | A | 0 | C | 1.45⇒1.32 | 9.0 | B | 159 |
| 22 | A | 0 | B | 1.45⇒1.36 | 6.2 | C | 149 |
| 23 | A | 0 | C | 1.45⇒1.31 | 9.7 | B | 159 |
| 24 | A | 0 | A | 1.45⇒1.42 | 2.1 | C | 143 |
| 25 | A | 0 | C | 1.45⇒1.31 | 9.7 | A | 160 |
| 26 | A | 0 | A | 1.45⇒1.42 | 2.1 | D | 138 |
| 27 | A | 0 | C | 1.45⇒1.31 | 9.7 | B | 155 |
| 28 | A | 0 | A | 1.45⇒1.42 | 2.1 | D | 133 |
| 29 | A | 0 | D | 1.45⇒1.30 | 10.3 | B | 156 |
| 30 | A | 0 | A | 1.45⇒1.42 | 2.1 | D | 132 |
| 31 | A | 0 | D | 1.45⇒1.29 | 11.0 | B | 157 |

TABLE 4-continued

| Example No. | transfer efficiency [number] | | | low-temperature fixability | | fixing release performance [° C.] | |
|---|---|---|---|---|---|---|---|
| 32 | A | 0 | A | 1.45⇒1.41 | 2.8 | D | 132 |
| 33 | A | 0 | D | 1.45⇒1.28 | 11.7 | B | 157 |
| 34 | A | 0 | A | 1.45⇒1.43 | 1.4 | D | 131 |
| 35 | A | 0 | D | 1.45⇒1.27 | 12.4 | B | 157 |
| 36 | A | 0 | A | 1.45⇒1.43 | 1.4 | D | 130 |
| 37 | A | 0 | D | 1.45⇒1.25 | 13.8 | B | 153 |
| Comparative 1 | A | 0 | A | 1.45⇒1.44 | 0.7 | E | 126 |
| Comparative 2 | A | 0 | A | 1.45⇒1.44 | 0.7 | E | 126 |

The present invention can provide a toner in which the low-temperature fixability coexists with the fixing release performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-151244, filed Aug. 1, 2016, and Japanese Patent Application No. 2017-133508, filed Jul. 7, 2017, which are hereby incorporated by reference herein in their entirety.

What is claimed is:

1. A toner comprising a toner particle containing an amorphous resin, a colorant, a release agent, and a crystalline resin;

the amorphous resin comprising an amorphous polyester resin A having a monomer unit derived from polyhydric alcohol and a monomer unit derived from polybasic carboxylic acid; and the content, in the monomer unit derived from polybasic carboxylic acid, of a monomer unit derived from at least one compound selected from the group consisting of tribasic and higher basic carboxylic acids and derivatives thereof is 25.0 to 80.0 mol %, wherein $3.0\times10^4$ Pa$\leq\eta_{0.01}\leq2.0\times10^5$ Pa, $2.0\leq[\eta_{0.69}/\eta_{0.01}]$, $2.5\times10^5$ Pa$\leq\eta_{0.01(A)}\leq7.5\times10^5$ Pa, and $3.0\leq[\eta_{0.69\ (A)}/\eta_{0.01(A)}]$ when $\eta_{0.01}$ represents the extensional viscosity of the toner at a Hencky strain at 90° C. of 0.01, $\eta_{0.69}$ represents the extensional viscosity of the toner at a Hencky strain at 90° C. of 0.69, $\eta_{0.01(A)}$represents the extensional viscosity of amorphous polyester resin A at a Hencky strain at 90° C. of 0.01 and $\eta_{0.69(A)}$ represents the extensional viscosity of amorphous polyester resin A at a Hencky strain at 90° C. of 0.69.

2. The toner according to claim 1, wherein $1.0\times10^5$ Pa$\leq\eta_{0.69}\leq4.0\times10^5$ Pa.

3. The toner according to claim 2, wherein $1.0\times10^6$ Pa$\leq\eta_{0.69(A)}\leq2.0\times10^6$ Pa.

4. The toner according to claim 3, wherein the content of the amorphous polyester resin A in the toner is 40.0 to 70.0 mass %.

5. The toner according to claim 4, wherein the peak molecular weight of the amorphous polyester resin A is 3,900 to 7,000.

6. The toner according to claim 2, wherein the content of the amorphous polyester resin A in the toner is 40.0 to 70.0 mass %.

7. The toner according to claim 1, wherein $1.0\times10^6$ Pa$\leq\eta_{0.69(A)}\leq2.0\times10^6$ Pa.

8. The toner according to claim 7, wherein the content of the amorphous polyester resin A in the toner is 40.0 to 70.0 mass %.

9. The toner according to claim 1, wherein the content of the amorphous polyester resin A in the toner is 40.0 to 70.0 mass %.

10. The toner according to claim 1, wherein the content of the release agent in the toner is 3.0 to 5.0 mass %.

11. The toner according to claim 1, wherein the peak molecular weight of the amorphous polyester resin A is 3,900 to 7,000.

* * * * *